US008141971B2

(12) United States Patent
Kondo

(10) Patent No.: US 8,141,971 B2
(45) Date of Patent: Mar. 27, 2012

(54) IMAGE RECORDING APPARATUS

(75) Inventor: Etsuyasu Kondo, Tama (JP)

(73) Assignee: Riso Kagaku Corporation, Tokyo (JP)

( * ) Notice: Subject to any disclaimer, the term of this patent is extended or adjusted under 35 U.S.C. 154(b) by 541 days.

(21) Appl. No.: 12/414,947

(22) Filed: Mar. 31, 2009

(65) Prior Publication Data

US 2009/0244124 A1 Oct. 1, 2009

(30) Foreign Application Priority Data

Apr. 1, 2008 (JP) ..... 2008-095503
Feb. 23, 2009 (JP) ..... 2009-039640

(51) Int. Cl.
*B41J 25/308* (2006.01)

(52) U.S. Cl. ..... 347/8; 347/37; 347/40

(58) Field of Classification Search ..... 347/5, 8, 347/9, 14, 20, 37, 40, 42
See application file for complete search history.

(56) References Cited

U.S. PATENT DOCUMENTS 7,270,387 B2 * 9/2007 Ueda et al. ..... 347/8

FOREIGN PATENT DOCUMENTS

JP 2007-276427 A 10/2007

* cited by examiner

*Primary Examiner* — Juanita D Jackson
(74) *Attorney, Agent, or Firm* — Holtz, Holtz, Goodman & Chick, PC

(57) ABSTRACT

An image recording apparatus includes a recording section having a head holding member holding a plurality of head units ejecting ink, and a position adjusting mechanism including position adjusting members, each being provided for each head unit, for adjusting a position of the head unit relative to the head holding member according to movement thereof, a driving mechanism for generating a force moving the position adjusting member, and transmission mechanisms, each being provided for each position adjusting member, for transmitting the force generated by the driving mechanism to the position adjusting member, the driving mechanism selecting the transmission mechanism to be transmitted with the force from the plurality of transmission mechanisms to supply the force to only the selected transmission mechanism.

20 Claims, 16 Drawing Sheets

IMAGE RECORDING APPARATUS

CROSS-REFERENCE TO RELATED APPLICATIONS

This application is based upon and claims the benefit of priority from prior Japanese Patent Applications No. 2008-095503, filed Apr. 1, 2008; and No. 2009-039640, filed Feb. 23, 2009, the entire contents of both of which are incorporated herein by reference.

BACKGROUND OF THE INVENTION

1. Field of the Invention

The present invention relates to an image recording apparatus which records an image on a recording medium.

2. Description of the Related Art

Conventionally, an image recording apparatus which records an image on a recording medium such as a sheet or a paper is known. As such image recording apparatuses, there are a serial printer, which performs image recording while scanning a recording head in a widthwise direction of a recording medium, and a line printer, where a line head is configured by fixing a recording head in a widthwise direction of a recording medium to perform image recording.

In the above printers, a plurality of recording heads are used. In the line printer, especially, a plurality of recording heads are arranged in a widthwise direction of a recording medium in order to configure a line head.

When a plurality of recording heads are used in this manner, angles or intervals of individual recording heads must be adjusted for obtaining an image of high quality. In Jpn. Pat. Appln. KOKAI Publication No. 2007-276427, for example, a carriage that attached a recording head is arranged in one line so as to correspond to the maximum width of a recording medium. The carriages are connected to one another by adjusting screws, respectively. Intervals of the recording heads can be adjusted by rotating the adjusting screws. Angle adjustments of the recording heads are performed by rotating an eccentric cam.

BRIEF SUMMARY OF THE INVENTION

An image recording apparatus according to the present invention comprising: a recording section having a head holding member holding a plurality of head units ejecting ink; and a position adjusting mechanism including position adjusting members, each being provided for each head unit, for adjusting a position of the head unit relative to the head holding member according to movement thereof, a driving mechanism for generating a force which moves the position adjusting member, and transmission mechanisms, each being provided for each position adjusting member, for transmitting the force generated by the driving mechanism to the position adjusting member, wherein the driving mechanism selects the transmission mechanism to be transmitted with the force from the plurality of transmission mechanisms to supply the force to only the selected transmission mechanism.

Another image recording apparatus according to the present invention comprising: a recording section including a head holding member having a plurality of head units ejecting ink arranged in a direction perpendicular to a conveying direction of a recording medium; and a position adjusting mechanism including position adjusting members, each being provided for each head unit, for adjusting a position of the head unit relative to the head holding member according to movement thereof, a driving mechanism for generating a force which moves the position adjusting member, and transmission mechanisms, each being provided for each position adjusting member, for transmitting the force generated by the driving mechanism to the position adjusting member, wherein the driving mechanism selects the transmission mechanism to be transmitted with the force from a plurality of the transmission mechanisms according to movement in a direction perpendicular to a conveying direction of the recording medium, thereby supplying the force to only the selected transmission mechanism.

Further, another image recording apparatus according to the present invention comprising: a recording section including a head holding member having a plurality of head units ejecting ink arranged in a direction perpendicular to a conveying direction of a recording medium; a position adjusting mechanism including position adjusting members, each being provided for each head unit, for adjusting a position of the head unit relative to the head holding member according to movement thereof, a driving mechanism for generating a force which moves the position adjusting member, and transmission mechanisms, each being provided for each position adjusting member, for transmitting the force generated by the driving mechanism to the position adjusting member; an imaging section which images an image recorded on the recording medium by the recording section; and a control section calculating adjusting amounts of the head units from the image imaged by the imaging section to control the position adjusting mechanism based upon the calculated adjusting amounts, wherein the driving mechanism selects the transmission mechanism to be transmitted with the force from the plurality of transmission mechanisms according to movement in a direction perpendicular to the conveying direction of the recording medium based upon the adjusting amount calculated by the control section, thereby supplying the force to only the selected transmission mechanism.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained below in detail with reference to the drawings.

Figure 1:
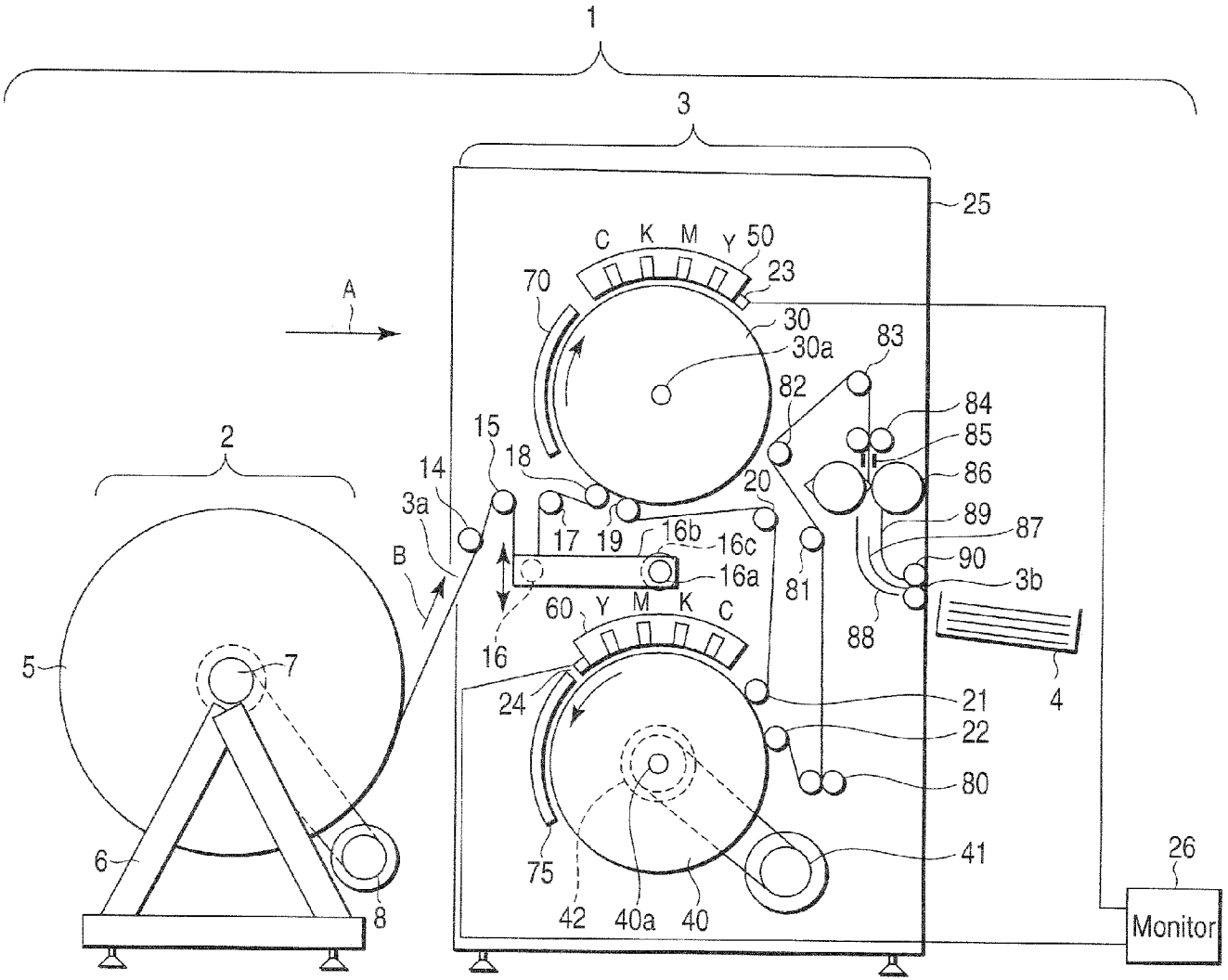
FIG. 1 is a schematic front diagram showing a conveying system of a recording medium in an image recording apparatus according to a first embodiment.
Figure 2:
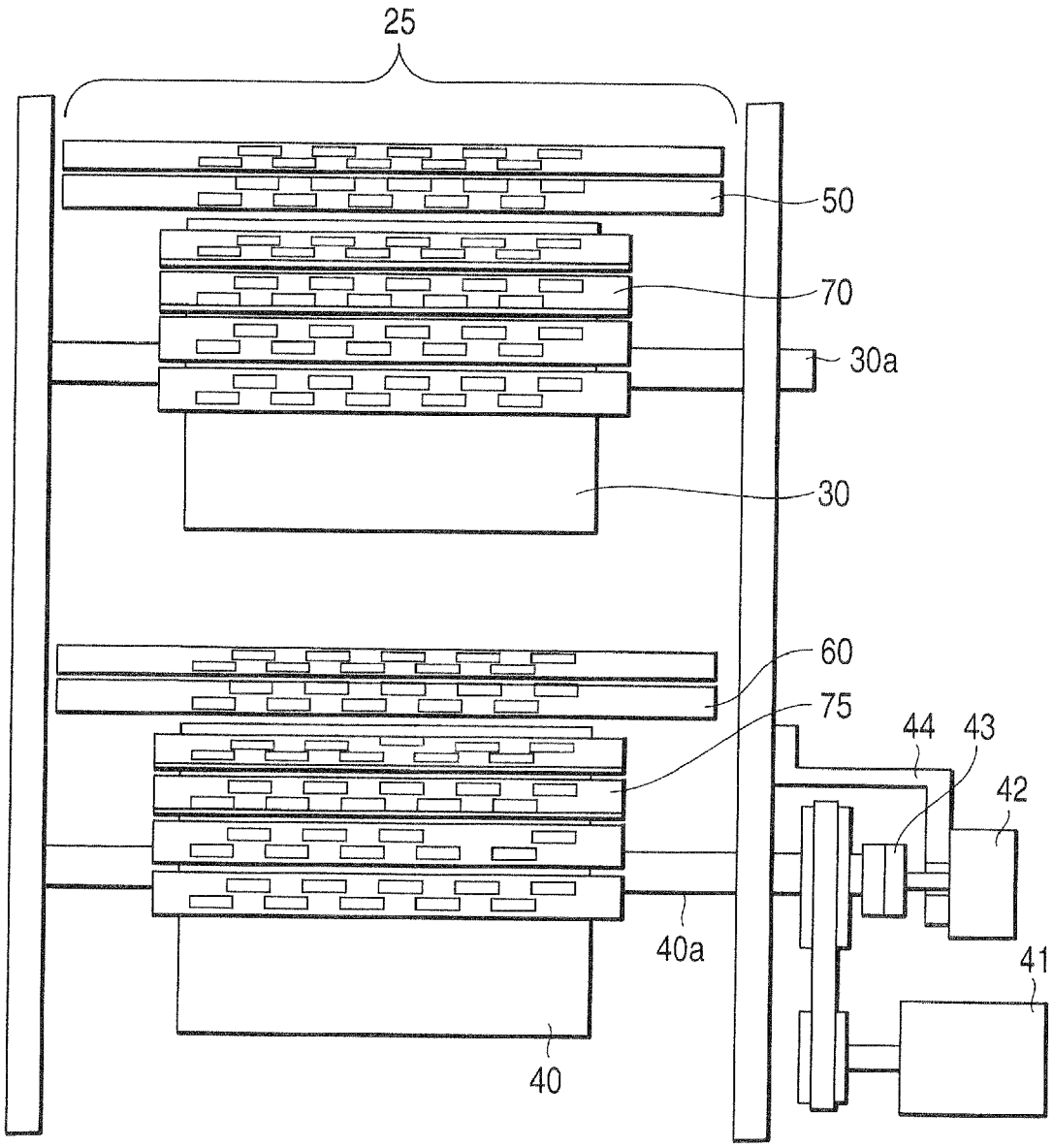
FIG. 2 is a schematic side diagram showing a recording apparatus main body as viewed from a direction of arrow A in FIG. 1.

FIG. 1 is a schematic front diagram showing a conveying system for a recording medium 5 in an image recording apparatus 1 according to a first embodiment. FIG. 2 is a schematic side diagram showing a recording apparatus main body as viewed from a direction of arrow A in FIG. 1.

The image recording apparatus 1 is mainly provided with an unwinding section 2, a recording apparatus main body 3, and a stacker section 4. A configuration of the unwinding section 2 serving as a recording medium supplying section shown in FIG. 1 will first be explained.

The unwinding section 2 comprises an recording medium 5 wound in a roll shape, a paper tube fixing shaft 7 penetrating the center of the recording medium 5, a stand 6 rotatably holding the paper tube fixing shaft 7, and a brake 8 adjusting an unwinding state of the recording medium 5 if necessary. With this configuration, the recording medium 5 is supplied to the recording apparatus main body 3. For example, a continuous medium such as roll paper is used as the recording medium 5.

The paper tube fixing shaft 7 is provided with a plurality of nail portions (not shown) protruded in a radial direction when air is charged in the paper tube fixing shaft 7. The plurality of nail portions is bitten into an inner face of a paper tube of the recording medium 5 by charging air. Thereby, the paper tube fixing shaft 7 holds the recording medium 5 firmly. The brake 8 is coupled to the paper tube fixing shaft 7 via a belt. The brake 8 provides a function of imparting tension to the recording medium 5 in a reverse direction to a conveying direction of the recording medium 5.

Next, a configuration of the recording apparatus main body 3 will be explained with reference to FIG. 1 and FIG. 2.

The recording apparatus main body 3 comprises a first drum 30 and a second drum 40 disposed so as to partially overlap with each other at least in the direction of gravity, a first recording section 50 disposed so as to face the first drum 30, a second recording section 60 disposed so as to face the second drum 40, a first maintenance unit 70 disposed near the first recording section 50, a second maintenance unit 75 disposed near the second recording section 60, a conveying path for the recording medium 5, and a cutting section 86 cutting the recording medium 5. These constituent members are mounted on a main body frame 25.

The conveying path for the recording medium 5 comprises a plurality of rollers 14 to 22 and rollers 80 to 84.

First, the recording medium 5 supplied from a supplying port 3*a* into the recording apparatus main body 3 is conveyed to the first drum 30 via a conveying system comprising a free roller 14, a free roller 15, a swinging roller 16, a free roller 17, and a free roller 18. The free rollers 14, 15, 17, and 18 are rotatably held to the main body frame 25, respectively.

The swinging roller 16 is rotatably attached to one end portion of an arm 16*b*. The other end portion of the arm 16*b* is rotatably held to the main body frame 25 to be rotatable about a rotation center 16*a*. The swinging roller 16 and the arm 16*b* configures a tension generating section imparting tension to the recording medium 5 according to their weights. The tension generating section also serves to cancel any slack in the recording medium 5 supplied from the unwinding section 2.

Further, a potentiometer 16*c* is provided on the rotation center 16*a*. The potentiometer 16*c* detects a rotation position of the rotation center 16*a* when the swinging roller 16 is moved vertically. The brake 8 is controlled according to an output signal detected by the potentiometer 16*c*. The tension of the recording medium 5 is controlled in this manner.

The recording medium 5 conveyed to the first drum 30 is wound on the first drum 30 at an angle of 330° by the free rollers 18 and 19. The first drum 30 is a hollow cylinder made of aluminum, for example. A rotation shaft 30*a* of the first drum 30 is rotatably held to the main body frame 25. The rotation shaft 30*a* is engaged with one end of a member supporting the first recording section 50, described later, and one end of a member supporting the first maintenance unit 70, described later.

The first drum 30 is rotated in a clockwise direction via the recording medium 5. That is, the first drum 30 conveys the recording medium 5 in a direction shown by arrow in FIG. 1. The first recording section 50 performs recording on a surface of the recording medium 5.

The abovementioned winding angle of the recording medium 5 on the first drum 30 is set in the following manner. That is, if tension on a winding end side of the first drum 30 is represented as T2, tension on a winding start side of the first drum 30 is represented as T1, static friction coefficient between the first drum 30 and the recording medium 5 is represented as $\mu$, and a winding angle is represented as $\theta$, respective numerical values are set so as to satisfy a relationship of $T2/T1 \leqq \exp(\mu\theta)$.

For example, when T1 is 35N and T2 is 50N, $\theta$ is set to 330° such that slipping does not occur between the first drum 30 and the recording medium 5 even if the static friction coefficient $\mu$ is 0.07. A similar setting is performed for the second drum 40, described later.

By ensuring a winding angle to about 330° largely in this manner, the recording medium 5 comes in close contact with the first drum 30, so that accurate sheet conveyance and accurate control of a rotation speed of the first drum 30 are made possible.

Next, the recording medium 5 whose surface has been recorded with an image passes through the free rollers 19 and 20. The recording medium 5 is wound on the second drum 40 at a winding angle of 330° by the free rollers 21 and 22. Thereby, the recording medium 5 is brought into close contact with a cylindrical surface of the second drum 40 to be held thereon without occurrence of slipping between the recording medium 5 and the cylindrical surface of the second drum 40 like the first drum 30. At this time, a surface (a surface on which an image has been recorded) of the recording medium 5 is in close contact with the cylindrical surface of the second drum 40. The second drum 40 is also a hollow cylinder made of aluminum, for example, like the first drum 30. Incidentally, the free rollers 19, 20, 21, and 22 are also rotatably held by the main body frame 25.

A rotational shaft 40*a* of the second drum 40 is rotatably held by the main body frame 25. A driving motor 41 is coupled to the rotational shaft 40*a* via a pulley and a belt. By driving the driving motor 41, the second drum 40 is rotated in a counterclockwise direction shown by arrow in FIG. 1 to convey the recording medium 5. An image is recorded on a back face of the conveyed recording medium 5 by the second recording section 60. Thereby, duplex recording of the recording medium 5 is completed. Incidentally, the second drum 40 serves as a driving drum, while the first drum 30 is a driven drum rotated by the second drum 40 via the recording medium 5.

As shown in FIG. 2, an encoder 42 in a position detecting section is coupled to the rotational shaft 40*a* of the second drum 40 via a coupling 43. The encoder 42 is fixed to one end of a fixing member 44. The other end of the fixing member 44 is fixed to the main body frame 25.

The encoder 42 rotates according to rotation of the second drum 40 to output a detection pulse corresponding to a rotation position of the second drum 40. The detection pulse is input into a driving board (not shown) driving recording heads of the first recording section 50 and the second recording section 60. The recording head ejects ink according to a signal from the driving board. That is, the recording medium 5 is conveyed on the first drum 30 and the second drum 40 at the same speed without slipping. Thereby, the first recording section 50 and the second recording section 60 each can control ejecting of ink based upon the detection pulse. Incidentally, the rotational shaft 40*a* is engaged with one end of a member supporting the second recording section 60, described later, and one end of a member supporting the second maintenance unit 75 described later.

Next, configurations of the first recording section 50 and the second recording section 60 will be explained.

Figure 3:
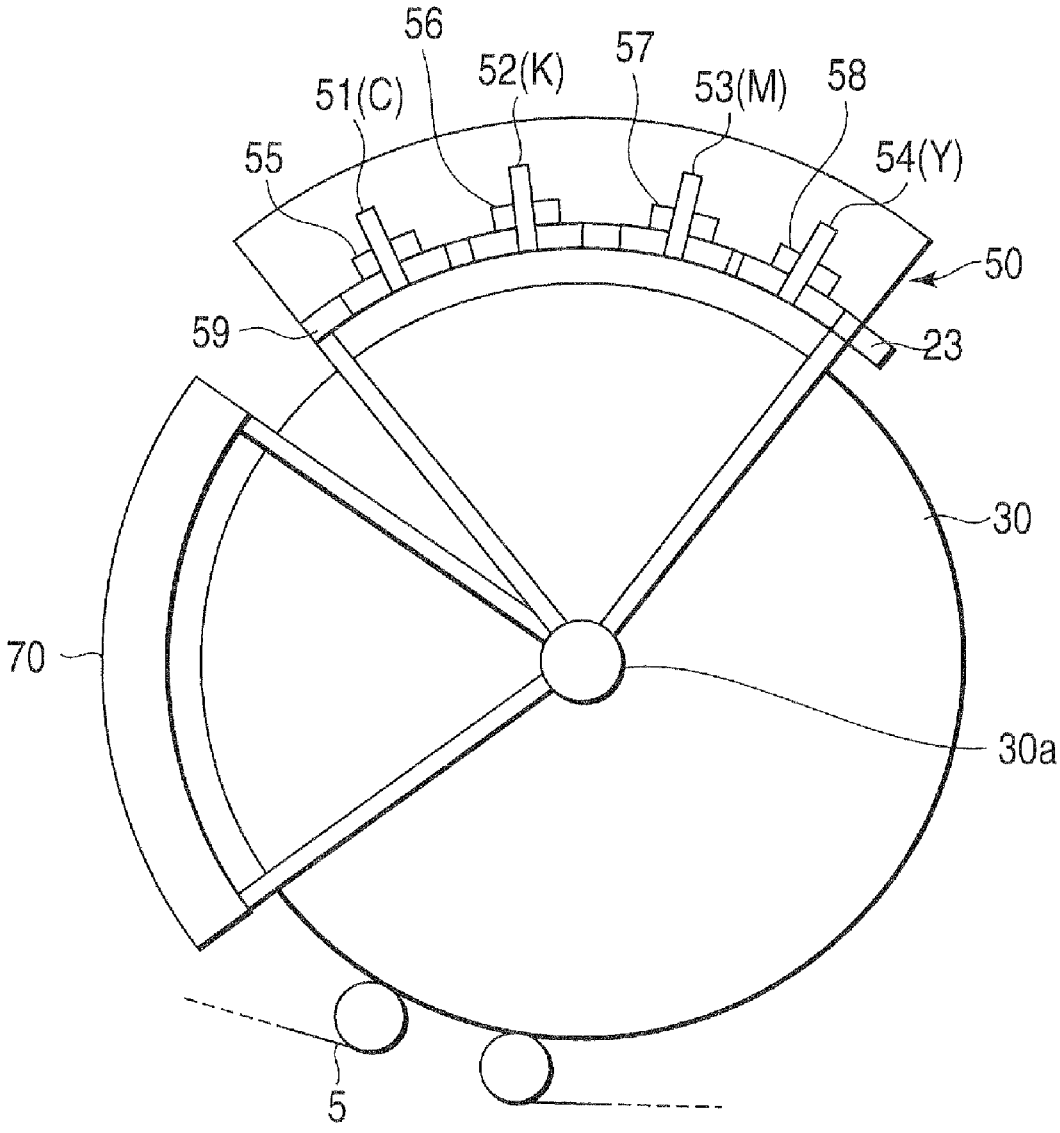
FIG. 3 is a diagram showing a configuration example of a first recording section, a drum type conveying system, and a first maintenance unit.

Here, since the first recording section 50 and the second recording section 60 have the same configuration, the first recording section 50 will be explained as a representative example. In FIG. 3, a configuration example of the first recording section 50, the first drum 30, and the first maintenance unit 70 is shown.

As shown in FIG. 3, the first recording section 50 includes head sections 51(C), 52(K), 53(M), and 54(Y) corresponding to total four colors of cyan (C), black (K), magenta (M), and yellow (Y). The head sections 51(C) to 54(Y) each include a plurality of head units.

Figure 4A:
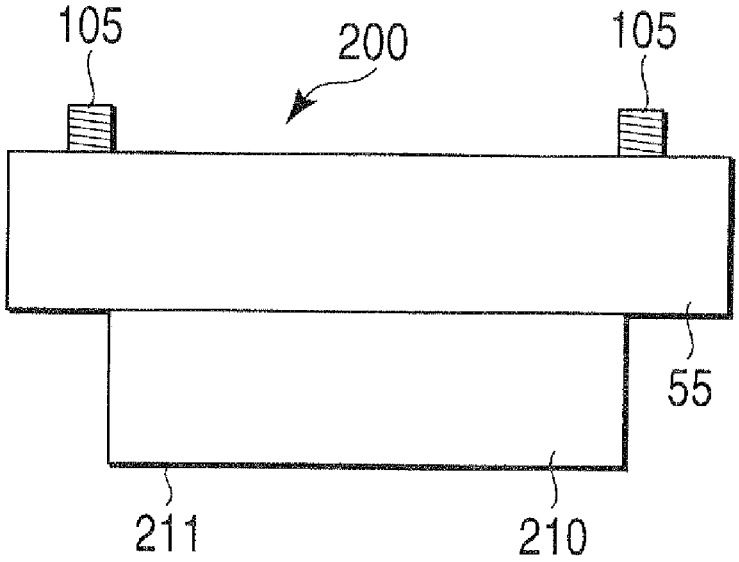
FIG. 4A is a diagram showing a side face of a head unit.
Figure 4B:
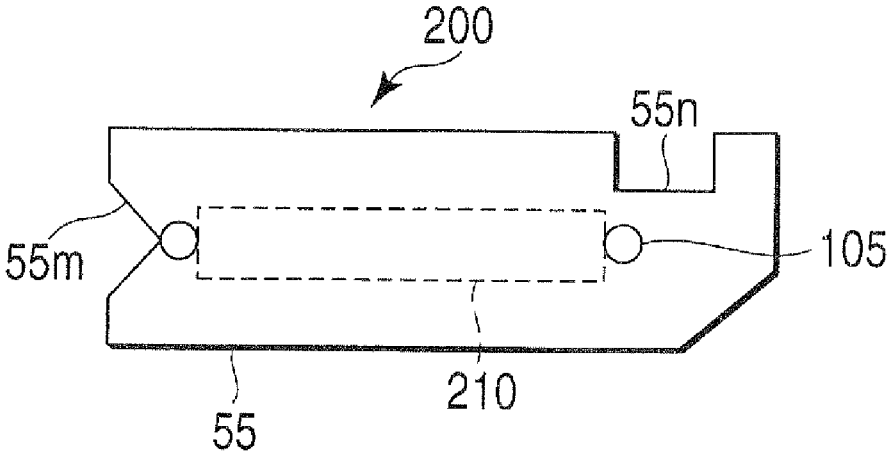
FIG. 4B is a diagram showing an upper face of the head unit.

In FIGS. 4A and 4B, for example, a head unit 200 in the head section 51(C) is shown. FIG. 4A shows a side face diagram of the head unit 200 and FIG. 4B shows an upper face diagram of the head unit 200.

As shown in FIG. 4A, the head unit 200 comprises a recording head 210 ejecting ink of color C and a head holder 55. The recording head 210 includes a nozzle face 211 ejecting ink. The head holder 55 is formed in an approximately rectangular shape, as shown in FIG. 4B. One short side of the head holder 55 has a V-shaped portion 55*m* formed by notching the one short side in a V shape. One corner of the other short side of the head holder 55 is cut off at an angle of 45°. One long side of the head holder 55 is formed with a removed portion 55*n*. Further, the head holder 55 is provided with at least two coil springs 105. The coil spring 105 always biases the head holder 55 toward a head holding member 59 so as to prevent the head holder 55 from floating from the head holding member 59. Of course, the biasing means is not limited to a coil spring, and a spring having a shape different from that of the coil spring or an elastic member such as rubber or resin may be used as the biasing means.

A plurality of the head units 200 configured in this manner are fixed to the head holding member 59 such that their nozzle faces 211 face a recording face of the recording medium 5 held on the first drum 30. Thereby, a head section 51(C) is configured. Incidentally, other head sections 52(K), 53(KM), and 54(Y) are similar to the head section 51(C).

Imaging elements for imaging a recorded image, for example, line sensors 23 and 24 are provided at downstream sides of the first recording section 50 and the second recording section 60 in their conveying directions. Images imaged by the line sensors 23 and 24 are displayed on a monitor 26. The line sensors 23 and 24 are used for adjustment of the recording heads. Incidentally, the line sensors 23 and 24 may be held by the head holding members 59.

Next, the first maintenance unit 70 and the second maintenance unit 75 will be explained. Here, since the first maintenance unit 70 and the second maintenance unit 75 have the same configuration, the first maintenance unit 70 is explained as a representative example.

As shown in FIG. 3, the first maintenance unit 70 which performs maintenance action such as wiping or nozzle sucking is disposed near the first recording section 50 in order to prevent clogging at the nozzle of the recording head.

The first maintenance unit 70 is provided with a suction nozzle and an ink pan (which are not shown).

The suction nozzle removes ink, paper powder or the like attached to the nozzle face by suction of a pump (not shown). The ink pan receives ink which has dropped from each recording head in a maintenance operation time.

In FIG. 1, a state where image recording is performed is shown. At this time, the first and second maintenance units 70 and 75 are retreated near the first recording section 50 and the second recording section 60.

When maintenance processing is performed, the first and second recording sections 50 and 60 are first ascended, so that a space between the first recording section 50 and the first drum 30 and a space between the second recording unit 60 and the second drum 40 are formed. The first and second maintenance units 70 and 75 are rotated to be inserted into the spaces. The suction nozzles are caused to face the recording heads of the first and second recording sections 50 and 60 so that maintenance utilizing suction is started. Of course, the maintenance can be performed in an appropriate combination with ink purging or wiping. After the maintenance processing is terminated, the first and second maintenance units 70 and 75 are retreated from their maintenance positions, so that they are moved to retreating positions such as shown in FIG. 1.

The recording medium 5 where images have been recorded on both side faces by the first recording section 50 and the second recording section 60 reaches a second nip roller pair 84 via a first nip roll pair 80, and free rollers 81, 82, and 83. Further, the recording medium 5 is conveyed to the cutter section 86 from the second nip roller pair 84 via an introducing guide 85. Incidentally, it is unnecessary to perform image recording on both side faces of the recording medium 5. The recording medium 5 is cut to a predetermined length to be received in the stacker section 4 as a cut sheet 87 while guided by stacker guides 88 and 89.

Next, the head holding member 59 and a position adjusting mechanism of each of the head section 51 to 54 will be explained in detail.

Figure 5A:
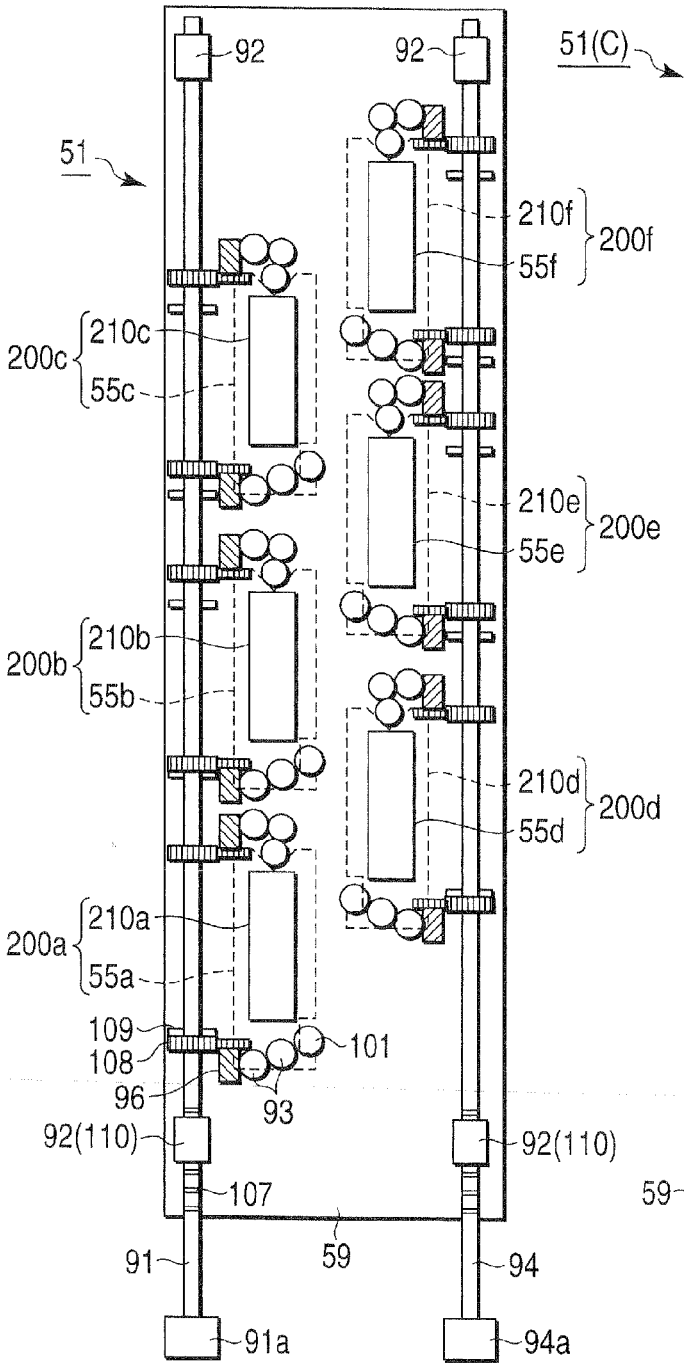
FIG. 5A is a diagram showing a configuration of a position adjusting mechanism as viewed from a nozzle face side (a lower face side)

The head section 51 will be herein explained as a representative one. The other head sections 52 to 54 have the same configuration as that of the head section 51. FIG. 5A shows a configuration of the head section 51 as viewed from a nozzle face side (a lower face side) and FIG. 5B shows a configuration of the head section 51 as viewed from an outer side (an upper face side).

Figure 5B:
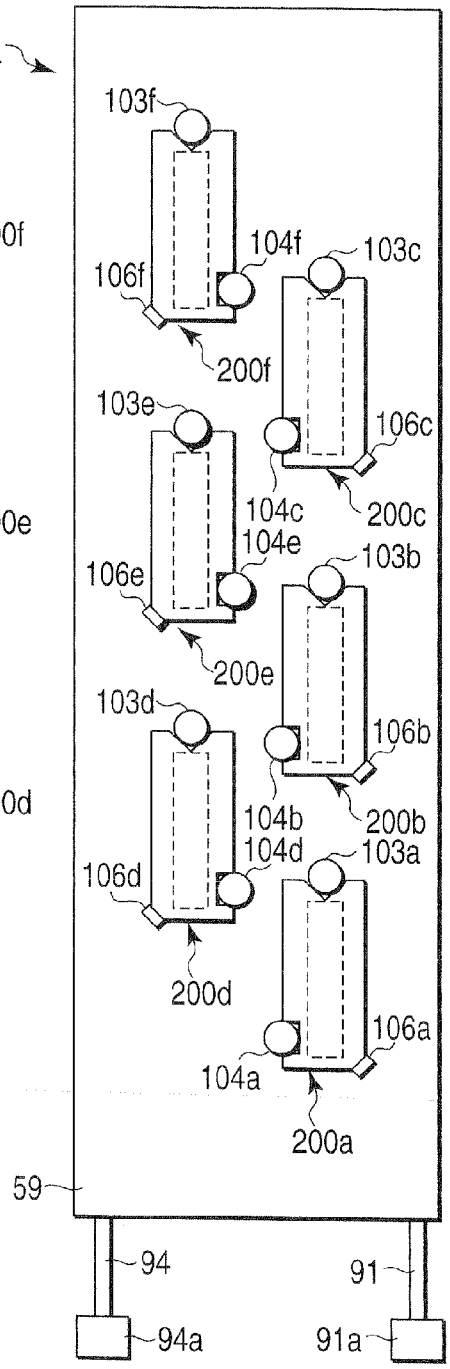
FIG. 5B is a diagram showing a configuration of the position adjusting mechanism as viewed from an outer side (an upper face side)

As shown in FIG. 5A and FIG. 5B, a head unit 200*a* comprises a recording head 210*a* and a head holder 55*a*. Similarly, head units 200*b*, 200*c*, 200*d*, 200*e*, and 200*f* comprise recording heads 210*b*, 210*c*, 210*d*, 210*e*, and 210*f*, and head holders 55*b*, 55*c*, 55*d*, 55*e*, and 55*f*, respectively. Thus, six head units, 210*a* to 210*f*, are held by the head holding member 59. Specifically, openings (not shown) into which the recording heads 210*a* to 210*f* are inserted are provided in the head holding member 59. The recording heads 210*a* to 210*f* are inserted into the openings so that the head holders 55*a* to 55*f* are placed on the head holding member 59.

In this embodiment, the six head units 200*a* to 200*f* are arranged in a zigzag so as to form two lines, each line including three head units. Specifically, the head units 200*a* to 200*c* configure a first head unit line and the head units 200*d* to 200*f* configure a second head unit line. The respective head units in the first head unit line and the second head unit line are arranged such that blank occurs at an image recording time.

A shaft 91 is arranged outside the head units 200*a* to 200*c* (the first head unit line), while a shaft 94 is arranged outside the head units 200*d* to 200*f* (the second head unit line). In other words, one shaft is arranged for each head unit line. In this embodiment, the head section 51 (per one ink color) is configured so as to utilize two shafts.

The shafts 91 and 94 extend in a direction perpendicular to a conveying direction of the recording medium 5 (a longitudinal direction of the head holding member 59). Specifically, the shaft 91 extends in parallel with an arrangement direction of the head units 200*a* to 200*c*, while the shaft 94 extends in parallel with an arrangement direction of the head units 200*d* to 200*f*. At least both end portion sides of the shafts 91 and 94 are held by shaft supporting members 92 fixed to the head holding member 59. At this time, the shafts 91 and 94 are held such that they can be pushed, pulled, and rotated relative to the shaft supporting members 92.

One end of each of the shafts 91 and 94 is provided with grasping portions 91*a* and 94*a* which are grasped by an operator for pushing, pulling, and rotating the shafts 91 and 94. The grasping portions 91*a* and 94*a* are provided at outside positions from the head holding member 59. In other words, lengths of the shafts 91 and 94 are set to be longer than a length of the head holding member 59 in its longitudinal direction. Thereby, when the first and second recording sections 50 and 60 are assembled to the main body frame 25, the grasping portions 91*a* and 94*a* are exposed on side faces of the first drum 30 and the second drum 40. That is, an operator can directly grasp the grasping portions 91*a* and 94*a* merely by detaching a side face cover of the apparatus. Therefore, it is unnecessary to detach another constituent member or insert a jig or a hand of a worker or an operator between other constituent members.

A configuration of the position adjusting mechanism for adjusting positions of the head units 200*a* to 200*f* will be explained below.

As shown in FIG. 5A, each of the shafts 91 and 94 is provided with a plurality of U-shaped or V-shaped positioning grooves 107 and a plurality of protruding portions 109. Each of the shafts 91 and 94 extends through a plurality of shaft gears 108. Thereby, each of the shafts 91 and 94 can be pushed, pulled, and rotated relative to the plurality of shaft gears 108. The shaft gears 108 are rotatably held by the head holding member 59. Thus, the shafts and the plurality of shaft gears configure a driving mechanism.

In this embodiment, when the position of one head unit is adjusted, the adjustment is performed from two directions described later. Therefore, two sets of the shaft gears 108, the positioning groove 107, and the protruding portion 109 are required in order to adjust one head unit. In this embodiment, position adjustments of three head units per one shaft are individually performed for the respective head units.

Although described in detail later, the positioning grooves 107 are marks for fitting the protruding portion 109 to the shaft gear 108.

A gear 96, intermediate gears 93, and a position adjusting gear 101 configure a transmission mechanism (a gear mechanism). The transmission mechanism is provided corresponding to each shaft gear 108. The transmission mechanism is a mechanism for transmitting the force generated in the driving mechanism to a position adjusting member, described later. That is, the position adjusting member is moved by the force generated in the driving mechanism so that position adjustments can be individually performed on the respective head units 200*a* to 200*f*. Incidentally, the gear 96, the intermediate gears 93, and the position adjusting gear 101 are rotatably held by the head holding member 59, respectively.

Here, the position adjusting mechanism will be explained in detail using one head unit 200*a* on the side of the shaft 91 as a representative example, with reference to FIG. 6 and FIGS. 7A and 7B. Incidentally, the head units other than the head unit 200*a* have the same configuration as that of the head unit 200*a*.

Figure 6:
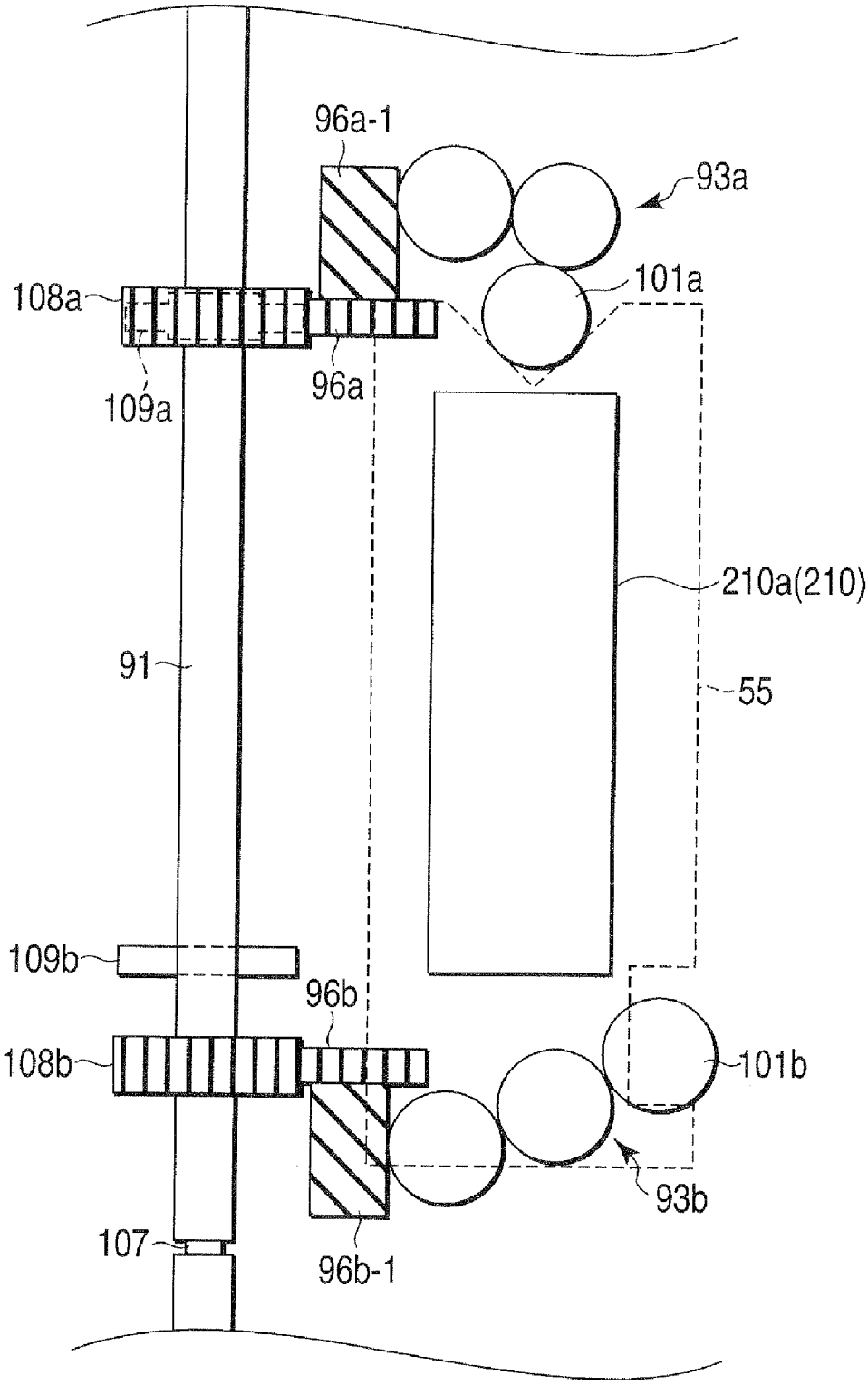
FIG. 6 is a diagram showing a configuration where the position adjusting mechanism in a head unit is provided.
Figure 7A:
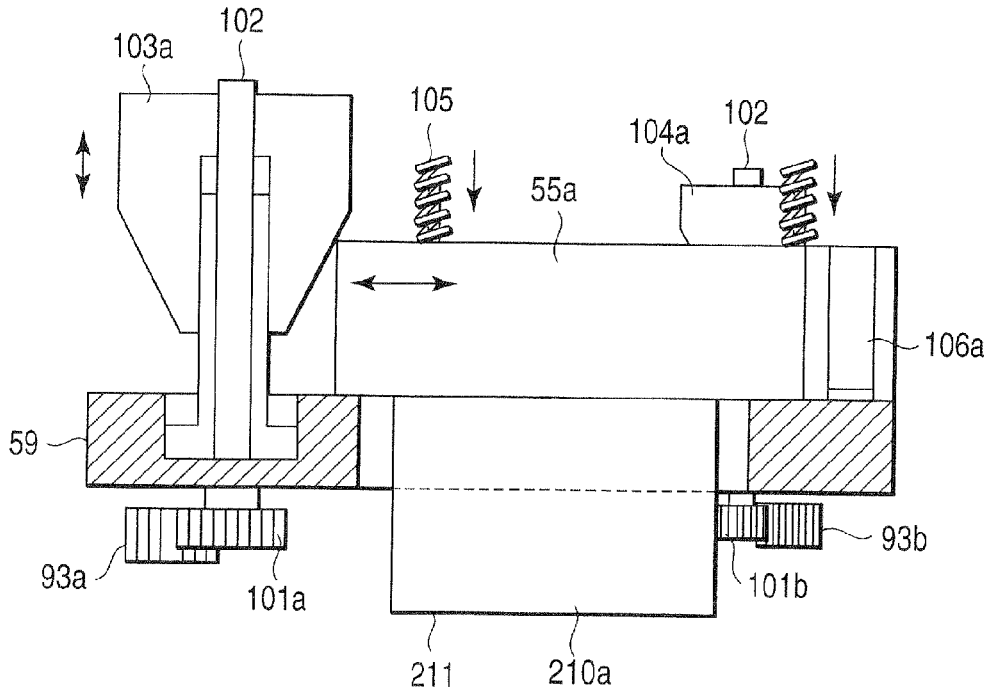
FIG. 7A is a side face diagram of the position adjusting mechanism in the head unit as viewed from a lateral direction thereof.
Figure 7B:
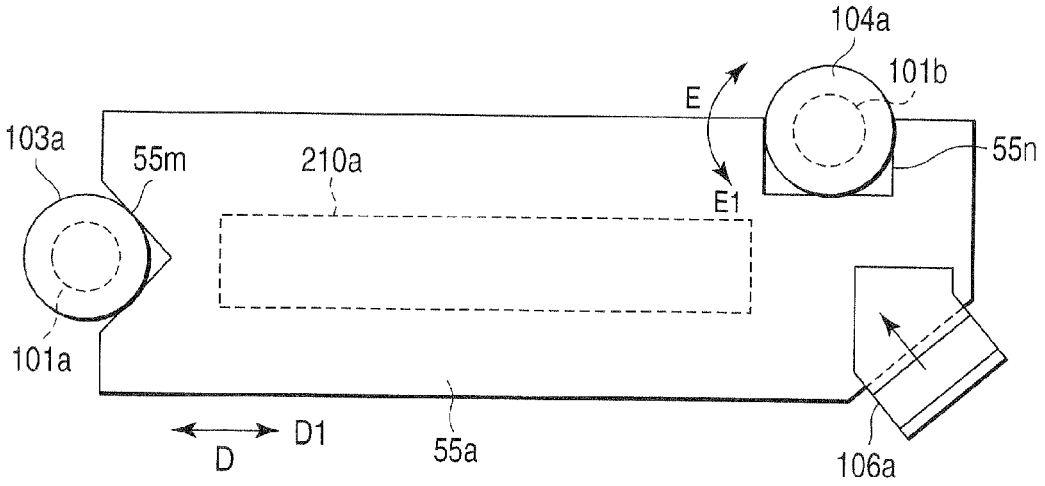
FIG. 7B is an upper face diagram of the position adjusting mechanism as viewed from the above.

FIG. 6 is a bottom face diagram of the position adjusting mechanism as viewed from a nozzle face side, FIG. 7A is a side face diagram of the position adjusting mechanism as viewed laterally, and FIG. 7B is an upper face diagram of the position adjusting mechanism as viewed from the above.

As shown in FIG. 6, a shaft gear 108*a* meshes with a gear 96*a*. Incidentally, the shaft gear 108*a* and the gear 96*a* are held on the head holding member 59 by a guide member (not shown) such that their meshing is not cancelled. The gear 96*a* is formed integrally with a worm gear 96*a*-1. The worm gear 96*a*-1 meshes with an intermediate gear 93*a* provided for transmission of rotation. Further, the intermediate gear 93*a* meshes with a position adjusting gear 101*a*. Accordingly, when the shaft gear 108*a* is rotated, the rotation thereof is transmitted to the position adjusting gear 101*a* via the gear 96*a*, the worm gear 96*a*-1, and the intermediate gear 93*a*. Thus, the gear 96*a*, the worm gear 96*a*-1, the intermediate gear 93*a*, and the position adjusting gear 101*a* configure the transmission mechanism (the gear mechanism).

A shaft gear 108*b* side is also configured like the shaft gear 108*a* side such that rotation of the shaft gear 108*b* is transmitted to a position adjusting gear 101*b* via a gear 96*b*, a worm gear 96*b*-1, and an intermediate gear 93*b*.

As shown in FIG. 5B and FIG. 7A, a position adjusting shaft 102 whose distal end is threaded and which extends through the head holding member 59 is to install upright the position adjusting gear 101*a*. The position adjusting shaft 102 is screwed with a first position adjusting member (a position adjusting pin) 103*a* having a conical shape portion as a position adjusting member. As shown in FIG. SA and FIG. 7A, a conical face of the position adjusting pin 103*a* abuts on both sides (or two portions) of the V-shaped portion 55*m* formed on the head holder 55*a*. By moving the position adjusting pin 103*a*, the head holder 55*a* is moved.

A position adjusting shaft 102 whose distal end portion is threaded is similarly to install upright the position adjusting gear 101*b*. The position adjusting shaft 102 is screwed with a second position adjusting member (a position adjusting pin) 104*a* having a conical shape portion serving as a position adjusting member. As shown in FIG. 7B, a conical face of the position adjusting pin 104*a* abuts on corner portions of the removed portion 55*n*. By moving the position adjusting pin 104*a*, the head holder 55*a* is moved.

The head holding member 59 is provided with a leaf-spring 106 serving as a first resilient member biasing the head holding member 59 in a direction perpendicular to a face of the head holder 55*a* removed at an angle of 45°. The leaf spring 106 always biases the head holder 55*a* such that the head holder 55*a* abuts on the position adjusting pin 103*a* and the position adjusting pin 104*a*.

The head holder 55*a* is biased toward the head holding member 59 side by coil springs 105 serving as second resilient members such that it is prevented from floating from the head holding member 59 side.

Figure 8A:
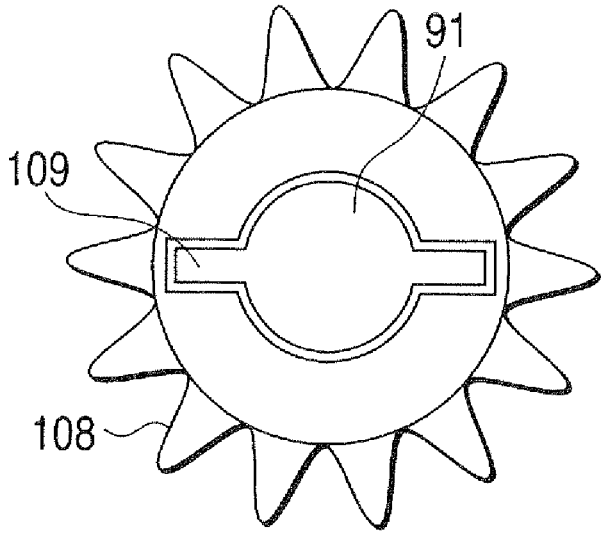
FIG. 8A is a diagram showing a state where a protruding portions have been fitted to a shaft gear.
Figure 8B:
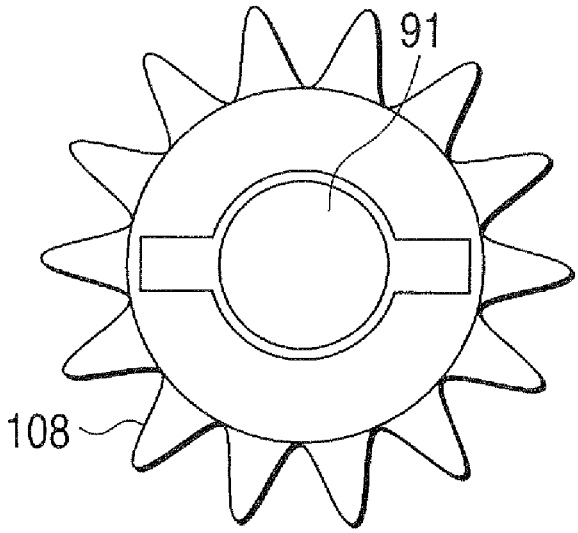
FIG. 8B is a diagram showing a state where the protruding portions are not fitted to the shaft gear.

Here, as shown in FIGS. 8A and 8B, a hole which allows passage of the shaft 91 and the protruding portions 109 is formed at the center of the shaft gear 108. FIG. 8A shows a state that the protruding portions 109 provided on the shaft 91 have been fitted in the hole of the shaft gear 108. FIG. 8B shows a state before the protruding portions 109 provided on the shaft 91 are fitted in the hole of the shaft gear 108.

In the state shown in FIG. 8A, since the protruding portions 109 are fitted in the hole, when the shaft 91 is rotated, the shaft gear 108 is also rotated.

As the state shown in FIG. 8B, since the protruding portions 109 are not fitted in the hole, even if the shaft 91 is rotated, the shaft gear 108 is not rotated. Thus, the state that the protruding portions 109 are not fitted in the hole is called the "free state".

In FIG. 6, since the shaft gear 108*a* and the protruding portions 109*a* have been fitted to each other, rotation of the shaft 91 is transmitted to the shaft gear 108*a*. At this time, the shaft gear 108*b* and the protruding portions 109*b* are in their free state (are not fitted to each other), and even if the shaft 91 is rotated, the rotation of the shaft 91 is not transmitted to the shaft gear 108*b*.

A method for performing selective switching between shaft gears 108 to be rotated in this manner will be explained with reference to schematic diagrams shown in FIG. 9A and FIG. 9B. Incidentally, in FIG. 9A and FIG. 9B, only shaft 91 will be explained, since shaft 94 is similar to shaft 91.

In the embodiment, the shaft 91 is formed with a plurality of U-shaped or V-shaped positioning grooves 107. By utilizing the positioning grooves, the shaft gear 108 to be fitted to the protruding portions 109 is selected.

A positioning detecting section (positioning selecting section) 110 for detecting positions of the positioning grooves 107 is provided. Incidentally, in the embodiment, the positioning selecting section 110 is configured integrally with the above-mentioned shaft supporting portion 92.

The positioning selecting section 110 includes a ball 110*a* and a spring 110*c*. The ball 110*a* is biased toward the shaft 91 by the spring 110*c*. The ball 110*a* is a spherical body having a diameter larger than a width of the positioning groove 107, and a distal end side of the ball 110*a* falls in the positioning groove 107. The ball 110*a* is fitted in the positioning groove 107 in this manner, so that a relative position between the protruding portion 109 and the shaft gear 108 can be set.

Figure 9A:
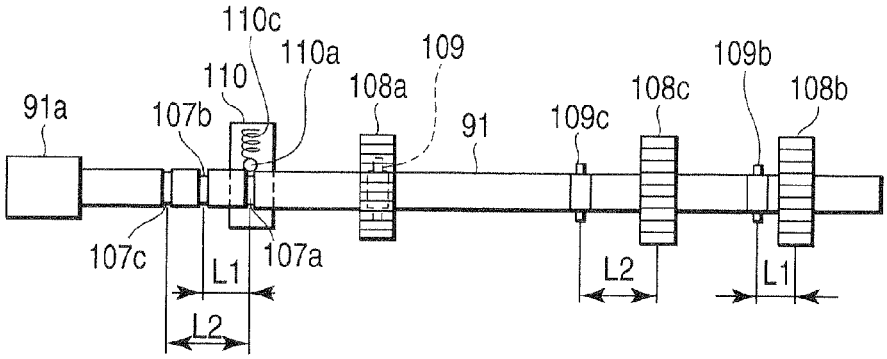
FIGS. 9A and 9B are diagrams for explaining selective switching among shaft gears.
Figure 9B:
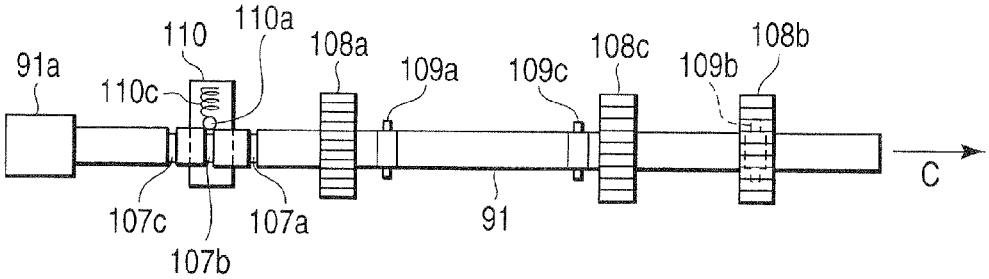

That is, in FIG. 9A, the protruding portion 109*a* is fitted in the shaft gear 108*a* in a state that the ball 110*a* has been fitted in a positioning groove 107*a*. At this time, the shaft gear 108*b* and the protruding portion 109*b* are not fitted to each other. Similarly, shaft gear 108*c* and the protruding portion 109*c* are not fitted to each other. Therefore, even if the shaft 91 is rotated, the shaft gears 108*b* and 108*c* are not rotated, and only the shaft gear 108*a* is rotated.

Here, a distance between the shaft gear 108*b* and the protruding portion 109*b* based upon the state shown in FIG. 9A is represented as L1. A positioning groove 107*b* is formed at a position separated from the positioning groove 107*a* by the distance L1. Thereby, when the shaft 91 is pushed from the state shown in FIG. 9A in a direction of arrow C, which is an axial direction of the shaft 91 by the distance L1, the ball 110*a* is fitted in the positioning groove 107*b*, which results in a fitted state of the protruding portion 109*b* into the shaft gear 108*b* (see FIG. 9B). At this time, fitting of the protruding portion 109*a* into the shaft gear 108*a* is cancelled. A non-fitting state between the shaft gear 108*c* and the protruding portion 109*c* is maintained. Therefore, even if the shaft 91 is rotated, the shaft gears 108*a* and 108*c* are not rotated and only the shaft gear 108*b* is rotated.

Similarly, a distance between the shaft gear 108*c* and the protruding portion 109*c* in the state shown in FIG. 9A is represented as L2. A positioning groove 107*c* is formed on the shaft 91 at a position separated from the positioning groove 107*a* by the distance L2. Thereby, when the shaft 91 is pushed from the state shown in FIG. 9A in a direction of arrow C by the distance L2, the ball 110*a* is fitted in the positioning groove 107*c*, which results in a fitted state of the protruding portions 109*c* into the shaft gear 108*c*. At this time, the protruding portion 109*a* and the protruding portion 109*b* are not fitted into the shaft gear 108*a* and the shaft gear 108*b*, respectively.

Accordingly, it is unnecessary to visually confirm whether or not the protruding portions 109 have been fitted in the shaft gears 108. That is, the ball 110*a* is fitted in the positioning groove 107 caused to correspond thereto in advance and the protruding portions 109 can be fitted in a desired shaft gear 108 when a "click" is generated or such feeling is obtained. By determining a positional relationship between the positioning grooves 107 and the protruding portions 109, solely the shaft gear 108 which should be rotated can be rotated. At this time, the other shaft gears 108 can be put in their free states without being rotated.

Next, position adjustment of the head unit will be explained with reference to FIG. 6 and FIGS. 7A and 7B.

Here, position adjustment of the head unit 200*a* is performed in a horizontal direction D (in a direction perpendicular to the conveying direction of the recording medium) and inclination adjustment of the head unit 200*a* to the conveying direction E is then performed.

As described above, the protruding portion 109*a* is first fitted into the hole of the shaft gear 108*a* by pushing or pulling the shaft 91. Next, the shaft 91 is rotated in the left or right direction according to the direction in which the head unit 200*a* is moved. The rotation is transmitted to the position adjusting gear 101*a* via the shaft gear 108*a*, the gear 96*a*, the worm gear 96*a*-1, and the intermediate gear 93*a*.

The position adjusting shaft 102 is also rotated according to the rotation of the position adjusting gear 101*a*. Thereby, the position adjusting pin 103*a* moves away from or toward the head holding member 59. In the embodiment, for example, the position adjusting pin 103*a* moves in a direction toward the head holding member 59. Thereby, the conical face of the position adjusting pin 103*a* pushes the V-shaped portion 55*m* of the head holder 55*a*. As a result, the head holder 55*a* is moved in a direction D1 away from the position adjusting shaft 102. The head holder 55*a* moves in a widthwise direction D of the recording medium 5 by moving the position adjusting pin 103*a* in this manner.

By operating the shaft 91, the protruding portion 109*b* is fitted in the shaft gear 108*b*. When the shaft 91 is rotated, the shaft gear 108*b* is rotated so that the rotation is transmitted to the position adjusting gear 101*b* via the gear 96*b*, the worm gear 96*b*-1, and the intermediate gear 93*b*.

According to the rotation of the position adjusting gear 101*b*, for example, the position adjusting pin 104*a* moves in a direction toward the head holding member 59. Thereby, the conical face of the position adjusting pin 104*a* pushes the removed portion 55*n* of the head holder 55*a*. As a result, the head holder 55*a* is moved in a direction E1 shown in FIG. 7B. By moving the position adjusting pin 104*a* in this manner, the head holder 55*a* is moved in a rotating direction about the position adjusting pin 103*a*.

As explained above, in the embodiment, position adjustments of the respective head units 200*a* to 200*f* in the first recording section 50 and the second recording section 60 are individually selectively performed from the side faces of the first drum 30 and the second drum 40.

In the embodiment, by moving the shaft in the axial direction, position adjustments of the head units are performed. That is, the inclination of the head unit or the interval between the head units can be adjusted utilizing movement of the shaft in just one direction.

In the embodiment, it is unnecessary to detach the other constituent members for position adjustment of the head unit.

Further, in the embodiment, since the position adjusting mechanism is provided in a dead space on the nozzle face side, effective use of space can be achieved.

Next, a first modified example of the first embodiment will be explained.

The driving mechanism of the abovementioned first embodiment is configured to selectively rotate one of the shaft gears by providing the plurality of protruding portions on the shaft. However, in the driving mechanism according to the first modified example, all the shaft gears are rotated according to rotation of the shaft.

In such a case, a method for adjusting the position of only a head unit to be adjusted from a plurality of head units individually will be explained in FIGS. 10A to 10D. Incidentally, in FIGS. 10A to 10D, the shaft 91 will be explained, but position adjustment regarding the shaft 94 is performed similarly.

Figure 10A:
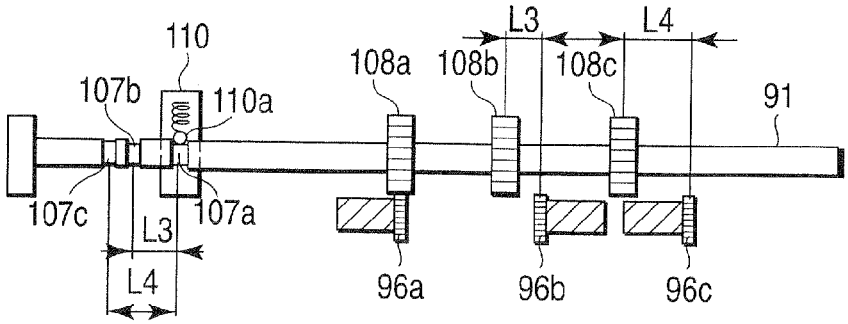
FIGS. 10A, 10B, 10C, and 10D are diagrams showing a first modified example in the first embodiment.
Figure 10B:
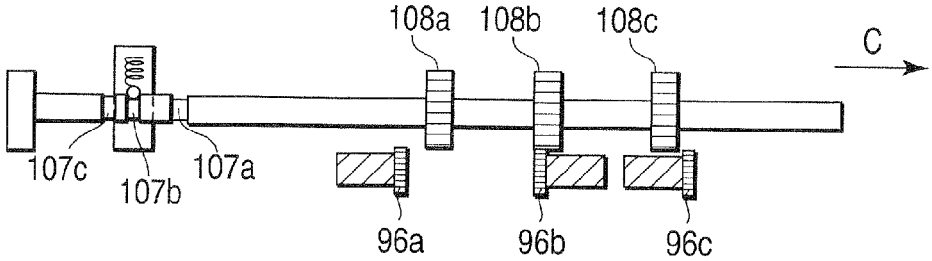
Figure 10C:
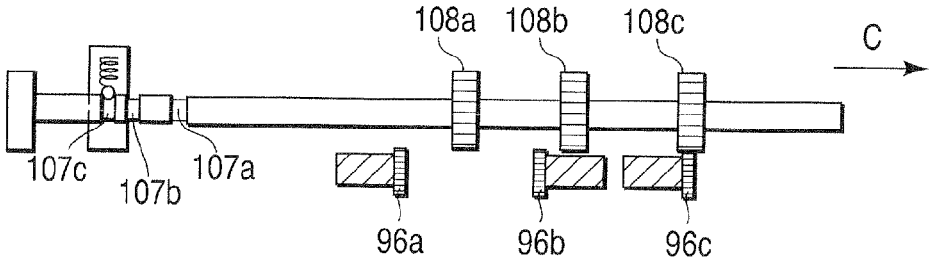

FIG. 10A shows a state that the ball 110*a* has been fitted in the positioning groove 107*a* and the shaft gear 108*a* and the gear 96*a* have been engaged with each other.

Based upon the state shown in FIG. 10A, a distance between the shaft gear 108*b* and the gear 96*b* is represented as L3. The positioning groove 107*b* is formed on the shaft 91 at a position separated from the positioning groove 107*a* by the distance L3. Thereby, when the shaft 91 is pushed from the state shown in FIG. 10A in a direction of arrow C, the shaft gears 108*a* to 108*c* are also moved according to the movement of the shaft 91 by the distance L3. Such a state is obtained that the ball 110*a* is fitted in the positioning groove 107*b* and the shaft gear 108*b* and the gear 96*b* are engaged with each other. At this time (see FIG. 10B), the shaft gear 108*a* and the gear 96*a* are not engaged with each other. Similarly, the shaft gear 108*c* and the gear 96*c* are not engaged with each other.

In the state shown in FIG. 10A, a distance between the shaft gear 108*c* and the gear 96*c* is represented as L4, and a positioning groove 107*c* is formed on the shaft 91 at a position separated from the positioning groove 107*a* by the distance L4. When shaft 91 is pushed from the state shown in FIG. 10A in a direction of arrow C by the distance L4, the ball 110*a* is fitted in the positioning groove 107*c*, and the shaft gear 108*c* and the gear 96*c* are put in an engaged state (see FIG. 10C).

Even if the shaft gears 108 are fixed on the shaft 91 in this manner, the gear 96 to be rotated can be selected according to a movement amount of the shaft 91. That is, solely the head unit to be adjusted can be selectively adjusted, like the first embodiment previously described.

Figure 10D:
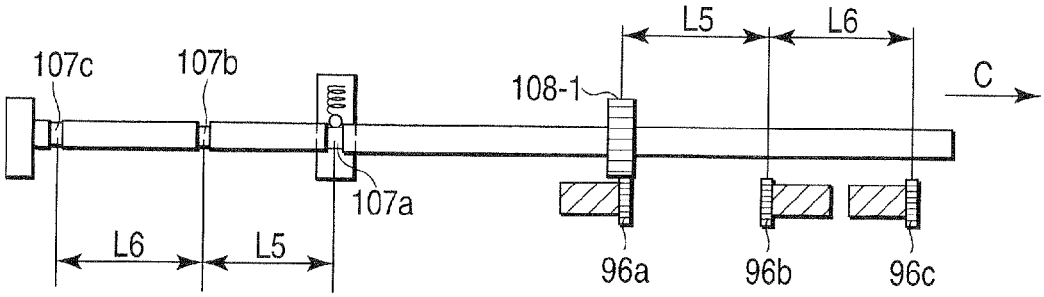

Incidentally, in the first modified example, the shaft gears 108*a* to 108*c* are provided corresponding to the gears 96*a* to 96*c*, but the present invention is not limited to such a configuration, and such a configuration as shown in FIG. 10D can be adopted. That is, in FIG. 10D, only one shaft gear 108-1 is caused to correspond to the gears 108*a* to 108*c*.

As shown in FIG. 10D, a distance between the gear 96*a* and the gear 96*b* is represented as L5 and the positioning groove 107*b* is formed at a position separated from the positioning groove 107*a* by the distance L5. A distance between the gear 96*b* and the gear 96*c* is represented as L6 and the positioning groove 107*c* is formed at a position separated from the positioning groove 107*b* by the distance L6. By adopting such a configuration, when the shaft 91 is pushed from the state shown in FIG. 10D in a direction of arrow C by the distance L5, the shaft gear 108-1 is also moved by the distance L5 according to the movement of the shaft 91. When the ball 110*a* is fitted in the positioning groove 107*b*, the shaft gear 108-1 and the gear 96*b* are put in an engaged state. The shaft 91 is further moved from this state by the distance L6. Thereby, the ball 110*a* is fitted in the positioning groove 107*c*, and the shaft gear 108-1 and the gear 96*c* are put in an engaged state. Thus, it is possible to adjust the respective head units individually using just one shaft gear 108-1.

Next, a second modified example of the first embodiment will be explained.

The driving mechanism of the first embodiment described above is configured to selectively rotate one of the shaft gears by providing the plurality of protruding portions on the shaft. However, in the driving mechanism according to the second modified example, one of the worm gears can be selectively rotated by providing leaf springs on the shaft and causing a protruding portion of a corresponding one of the leaf springs to be engaged with a corresponding one of the grooves formed on the worm gears.

A configuration of the second modified example will be explained with reference to FIGS. 11A to 11C and FIGS. 12A to 12C. Incidentally, in FIGS. 11A to 11C and FIGS. 12A to 12C, only shaft 91 will be explained, since shaft 94 is similar to shaft 91.

Recesses 403 are formed on the shaft 91. Leaf springs 404 are received in the recesses 403, respectively.

Figure 11A:
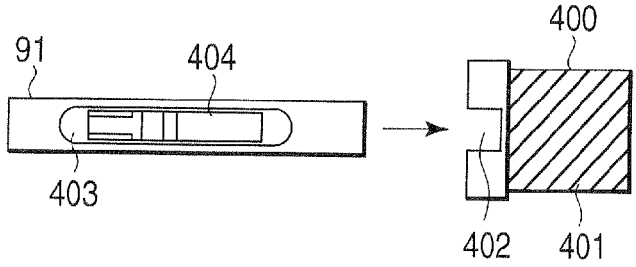
FIGS. 11A, 11B, and 11C are diagrams showing a second modified example in the first embodiment.
Figure 11C:
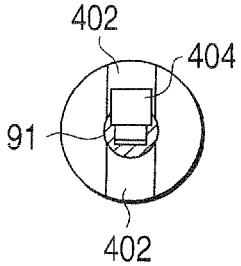
Figure 11B:
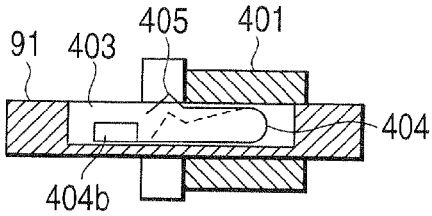

The leaf spring 404 is formed in a U shape as viewed from a side face thereof as shown in FIG. 11B. One end portion of the leaf spring 404 is formed with a protruding portion 405 and the other end portion thereof is fixed to the shaft 91 by a fixing portion 404*b*.

A worm gear 400 is formed with a through-hole for the shaft 91 and the shaft 91 extends through the through-hole. Thereby, the shaft 91 can be pushed, pulled and rotated relative to the worm gear 400.

When the shaft 91 extends through the through-hole of the worm gear 400, the protruding portion 405 of the leaf spring 404 is received in the recess 403 of the shaft 91 according to elastic deformation. Thereafter, the protruding portion 405 of the leaf spring 404 is fitted in either one of two grooves 402 formed on the worm gear 400.

Incidentally, in the first embodiment, a gear to be engaged with the shaft 91 is the shaft gear 108, but the gear to be fitted to the shaft 91 is directly fitted to the worm gear 400, so that the number of parts is reduced. The worm gear 400 is rotatably held by the head holding member 59, like the shaft gear 108.

Figure 12A:
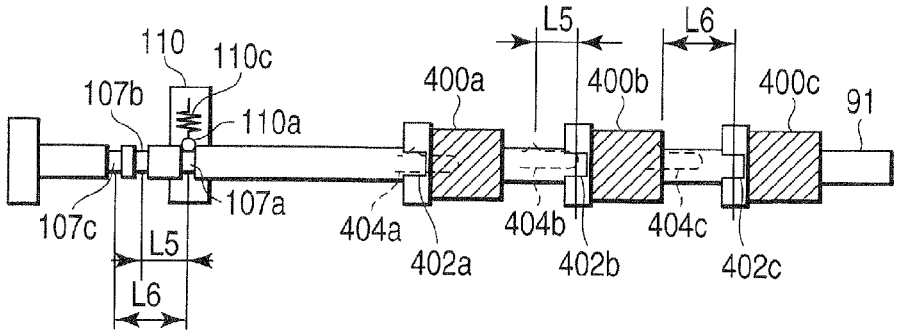
FIGS. 12A, 12B, and 12C are diagrams for explaining selective switching among shaft gears.

With such a configuration, a method for individually adjusting the position of only a head unit to be adjusted of a plurality of head units will be explained with reference to FIGS. 12A to 12C. In FIG. 12A, the ball 110*a* is fitted in the positioning groove 107*a* and the groove 402*a* of the worm gear 400*a* and the protruding portion 405 of the leaf spring 404*a* are engaged with each other.

Based upon the state shown in FIG. 12A, a distance between the groove 402*b* of the worm gear 400*b* and the protruding portion 405 of the leaf spring 404*b* is represented as L5. A positioning groove 107*b* is formed on the shaft 91 at a position separated from the positioning groove 107*a* by the distance L5.

Thereby, when the shaft 91 is pushed from the state shown in FIG. 12A in a direction of arrow C by the distance L5, the leaf springs 404*a* to 404*c* are also moved by the distance L5 according to the movement of the shaft 91. When the ball 110*a* is fitted in the positioning groove 107*b*, the groove 402*b* of the worm gear 400*b* and the protruding portion 405 of the leaf spring 404*b* are put in an engaged state. At this time (see FIG. 12B), the groove 402*a* of the worm gear 400*a* and the protruding portion 405 of the leaf spring 404*a* are in a disengaged state. Similarly, the groove 402*c* of the worm gear 400*c* and the protruding portion 405 of the leaf spring 404*c* are in a disengaged state. Therefore, even if the shaft 91 is rotated, the worm gears 400*a* and 400*c* are not rotated, and only the worm gear 400*b* is rotated.

In the state shown in FIG. 12A, a distance between the groove 402*c* of the worm gear 400*c* and the protruding portion 405 of the leaf spring 402*c* is represented as L6, and a positioning groove 107*c* is formed on the shaft 91 at a position separated from the positioning groove 107*a* by the distance L6. When the shaft 91 is pushed from the state shown in FIG. 12A in the direction of arrow C by the distance L6, the ball 110*a* is fitted in the positioning groove 107*c* and the groove 402*c* of the worm gear 400*c* and the protruding portion of the leaf spring 404*c* are put in an engaged state. At this time (see FIG. 12C), the groove 402*a* of the worm gear 400*a* and the protruding portion of the leaf spring 404*a* are in a disengaged state. Similarly, the groove 402*b* of the worm gear 400*b* and the protruding portion of the leaf spring 404*b* are also in a disengaged state.

Figure 12B:
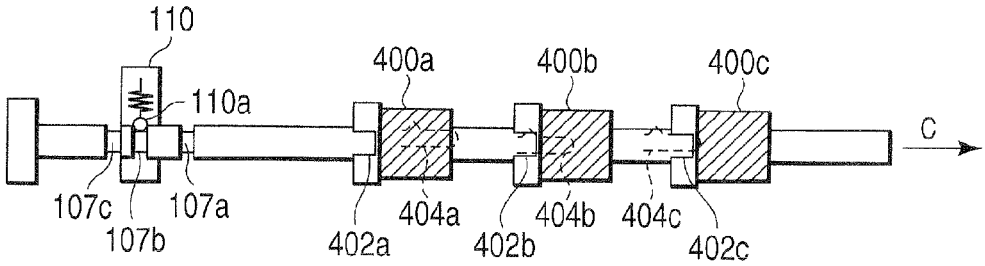
Figure 12C:
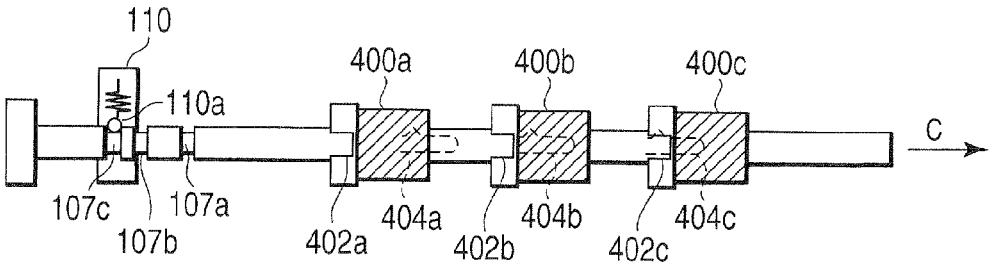

By adopting the leaf springs 404 in this manner, engagement of the shaft 91 with the worm gear 400 or disengagement therebetween can be performed easily simply by pushing and pulling the shaft 91 in the direction of arrow C shown in FIGS. 12B and 12C. Thereby, a working time for position adjustment can be reduced.

Incidentally, even if the protruding portion 405 of the leaf spring 404 is not engaged with the groove 402 of the worm gear 400, engagement therebetween can be achieved by rotating the shaft 91 when adjustment of the head units is started.

Next, an image recording apparatus according to a second embodiment will be explained.

Figure 13:
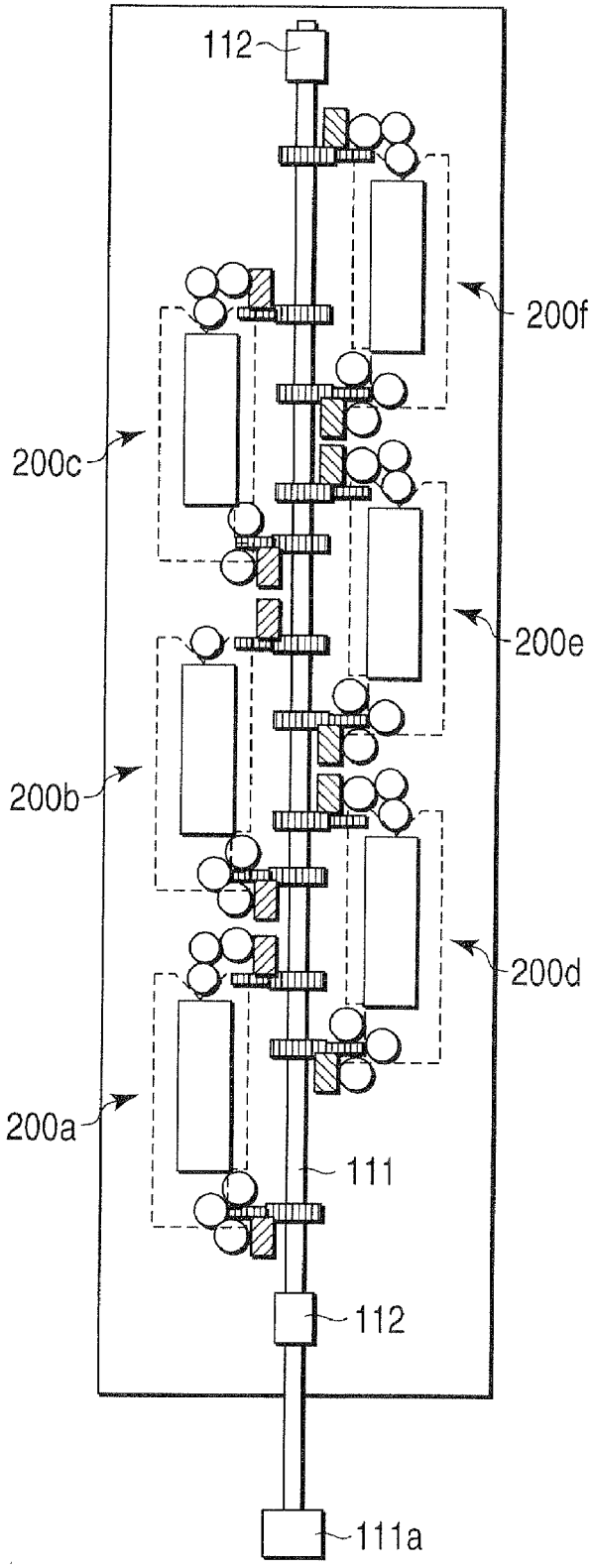
FIG. 13 is a diagram showing a configuration example of a position adjusting mechanism in an image recording apparatus according to a second embodiment.

FIG. 13 is a diagram showing a configuration example of a position adjusting mechanism of a head unit in the image recording apparatus according to the second embodiment. In the first embodiment described above, as shown in FIG. 5A, the configuration that two shafts are utilized for the head section 51(C) (per one ink color) is adopted. In the second embodiment, position adjustments of six head units are performed by one shaft. That is, in this embodiment, one shaft is provided for two head unit lines instead of such a configuration that one shaft is provided for each head unit line. Incidentally, this embodiment is different from the abovementioned first embodiment regarding only the configuration of the position adjusting mechanism, and both the embodiments are equal to each other regarding the other configurations, so that explanation of the other configurations is omitted. In FIG. 13, the positioning groove 107 and the protruding portion 109 are omitted.

As shown in FIG. 13, the head units 200*a* to 200*c* configure a first head unit line and the head units 200*d* to 200*f* configure a second head unit line. In this embodiment, a shaft 111 is disposed between the first head unit line and the second head unit line.

At least both ends of the shaft 111 are held by shaft supporting portions 112. The shaft 111 can be pushed, pulled, and rotated relative to the shaft supporting portions 112. One end of the shaft 111 is provided with a grasping portion 111*a* which is grasped by an operator for pushing, pulling, and rotating the shaft 111. The shaft 111 extends through shaft gears provided corresponding to the respective head units 200*a* to 200*f*. Thereby, the shaft 111 can be pushed, pulled, and rotated relative to the respective shaft gears.

Incidentally, the configuration of the position adjusting mechanism of the embodiment is different from that of the abovementioned first embodiment regarding only the number of head units to be adjusted by one shaft 111, and the configuration of the former is approximately the same as that of the latter. A method for performing individual position adjustment of a head unit to be adjusted of a plurality of head units is similar to that of the first embodiment.

Thus, in the second embodiment, it is possible to adjust the position of the recording head corresponding to one ink color by one shaft.

Next, an image recording apparatus according to a third embodiment will be explained. Incidentally, this embodiment is different from the abovementioned first embodiment regarding only the configuration of the position adjusting mechanism, and both the embodiments are equal to each other regarding the other configurations, so that explanation of the other configurations is omitted.

Figure 14:
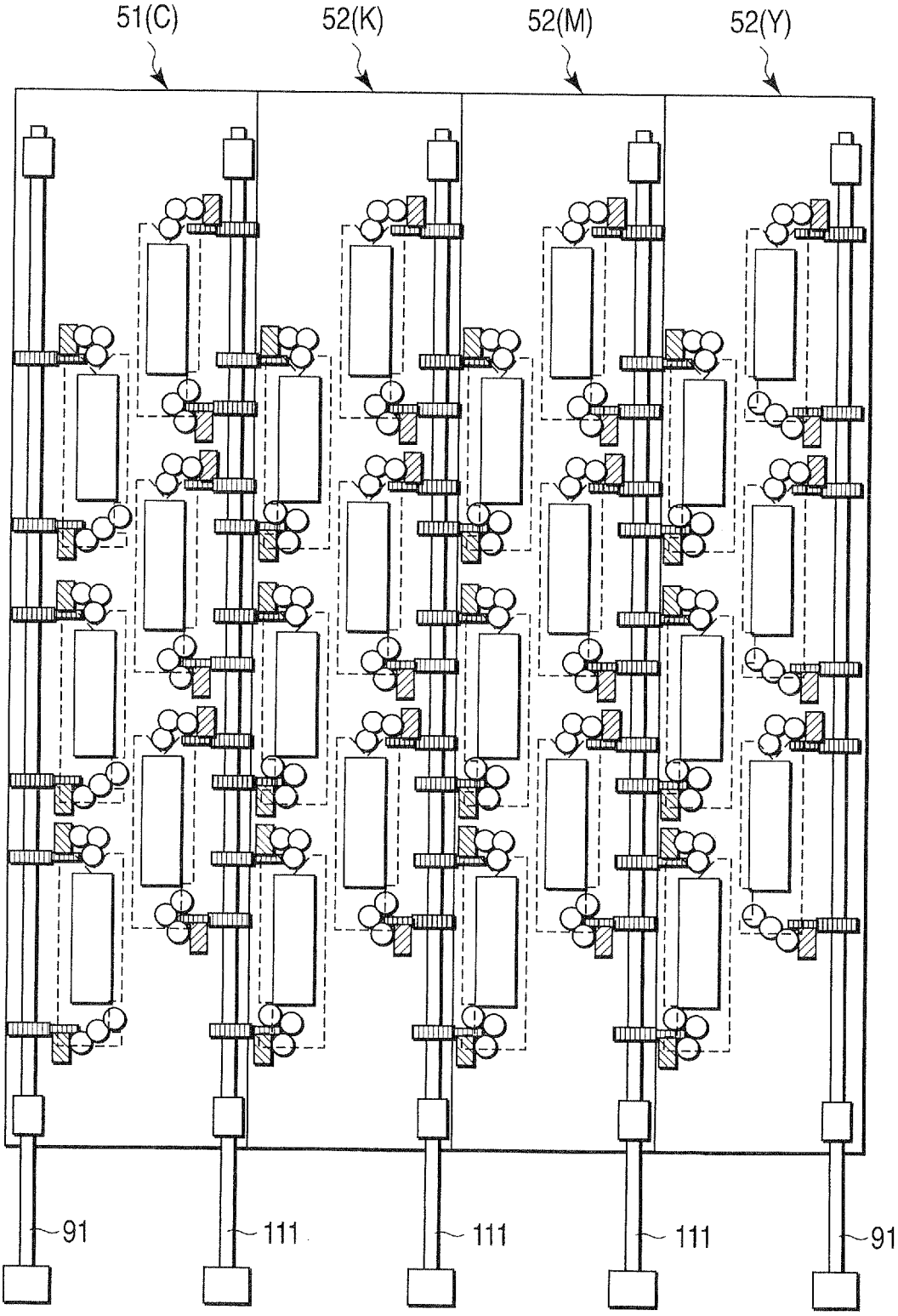
FIG. 14 is a diagram showing a configuration example of a position adjusting mechanism in an image recording apparatus according to a third embodiment.

FIG. 14 is a diagram showing a configuration example of a position adjusting mechanism of a head unit in the image recording apparatus according to the third embodiment. The position adjusting mechanism of this embodiment has a configuration obtained by combining the position adjusting mechanisms of the first embodiment and the second embodiment.

For example, a shaft 111 is disposed between a head unit line having three head units of the head section 51(C) on a downstream side of a conveying direction of a recording medium, and a head unit line having three head units of the head section 52(K) on an upstream side of the conveying direction, thereby performing position adjustment of six head units.

Similarly, shafts 111 are disposed between the head section 52(K) and the head section 53(M) and between the head section 53(M) and the head section 54(Y), respectively. Shafts 91 are disposed regarding the most upstream side of the conveying direction (a head unit line on the upstream side of the head section 51(C)) and the most downstream side of the conveying direction (a head unit line on the downstream side of the recording head section 54(Y)).

In the abovementioned first embodiment, it is necessary to provide eight shafts for adjusting the positions of all the head units individually. With this configuration, however, the positions of all the head units can be adjusted individually by five shafts, which can result in size reduction of the apparatus. By arranging a shaft between lines of the head units ejecting different ink colors, a distance between the head unit lines in each head section can be reduced.

Next, the image recording apparatus according to the fourth embodiment will be explained.

The fourth embodiment is directed to an image recording apparatus which can perform position adjustment of the head units automatically according to an analysis result of images picked up by the line sensors 23 and 24 shown in FIG. 1. Here, a position adjusting mechanism for the head section 51(C) will be explained as a representative example. Position adjusting mechanisms for the other head sections 52(K) to 54(Y) are similar to the position adjusting mechanism for the head section 51(C).

Figures 15A, 15B, 15C:
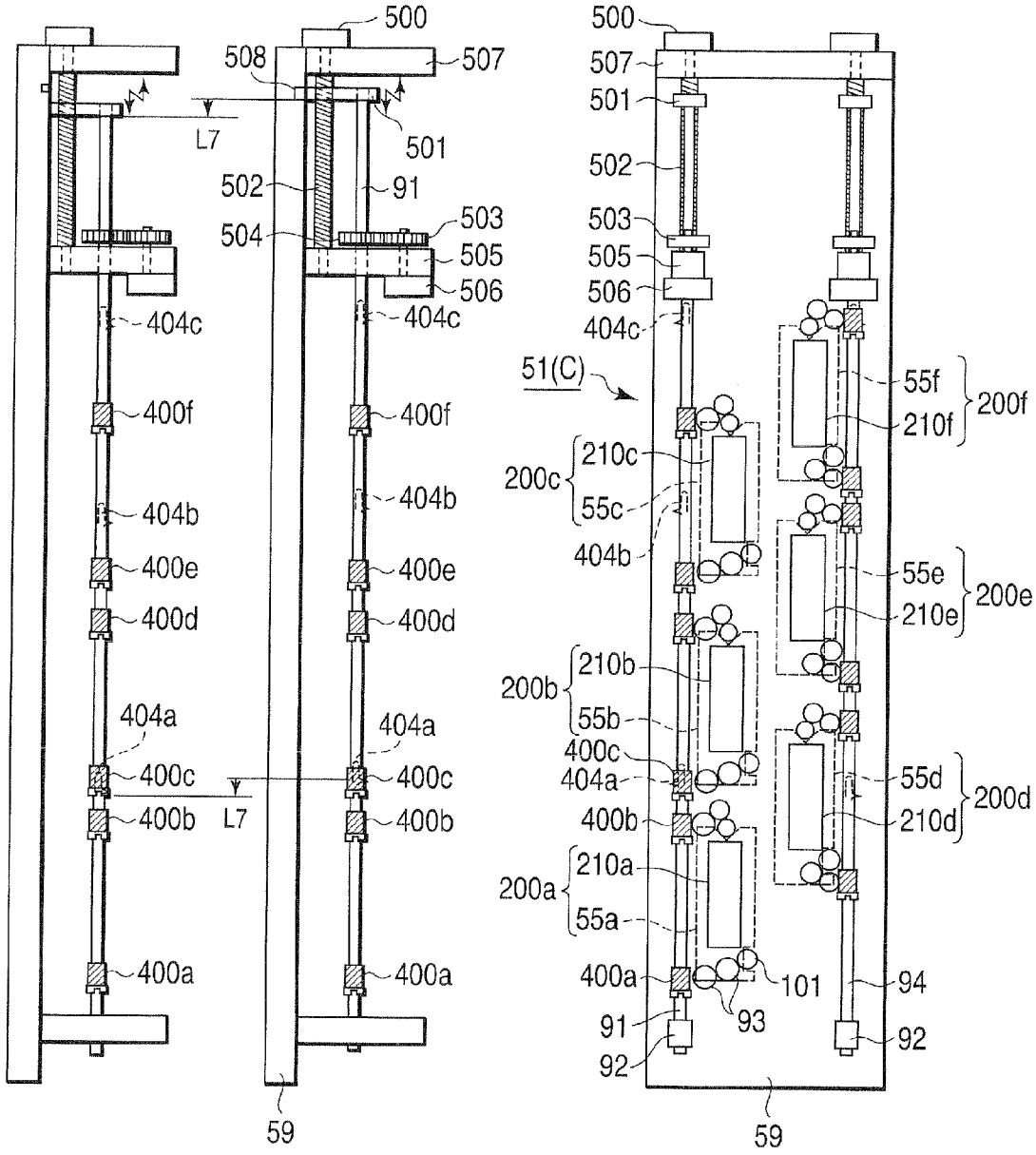
FIGS. 15A, 15B, and 15C are diagrams showing a position adjusting mechanism in an image recording apparatus according to a fourth embodiment.

FIG. 15A shows a configuration of a head section 51(C) as viewed from a nozzle face side (a lower face side) thereof, and FIG. 15B and FIG. 15C show a configuration of the head section 51(C) as viewed from a side face thereof. Incidentally, as shown in FIG. 15A, this embodiment has a configuration utilizing two shafts 91 and 94 to the head section like the abovementioned first embodiment.

A configuration of a driving mechanism for performing adjustments of respective head units automatically will be explained below. Incidentally, a configuration of the shaft 91 side will be explained below as a representative example.

As shown in FIG. 15A, the shaft 91 is formed with recesses, and leaf springs 404*a* to 404*c* are received in the recesses. The shaft 91 extends through worm gears 400 rotatably held by the head holding member 59. This configuration is similar to that of the second modified example of the first embodiment.

One end of the shaft 91 is held by a shaft supporting portion 92 so as to be capable of rotating, being pushed and pulled, and the other end thereof is rotatably held by an engagement member 501. The engagement member 501 is screwed with a lead screw 502.

The lead screw 502 extends so as to be parallel to an arrangement direction of the shaft 91 in a longitudinal direction of the head holding member 59. One end of the lead screw 502 is rotatably held by a supporting portion 505 and the other end thereof is rotatably held by a supporting portion 507. The supporting portion 505 and the supporting portion 507 are fixed on the head holding member 59. Incidentally, the supporting portion 505 is formed with a through-hole through which the shaft 91 extends.

A pulse motor 500 for moving the shaft 91 in an axial direction of the shaft 91 is fixed on the supporting portion 507. The lead screw 502 is rotated by driving the pulse motor 500. The engagement member 501 moves on the lead screw 502 according to the rotation of the lead screw 502. That is, the shaft 91 performs pushing and pulling actions in the axial direction via the engagement member 501 according to driving of the pulse motor 500.

Thus, the pulse motor 500 moves the shaft 91 in the axial direction, thereby causing the leaf spring 404 to be engaged with a groove of the worm gear 400 corresponding to a head unit to be adjusted of a plurality of head units.

Here, the position of the shaft 91 is detected by an origin sensor 508 provided on the head holding member 59. The origin sensor 508 detects the position of the engagement member 501. In the embodiment, the position shown in FIG. 15B is set as a starting point of the shaft 91.

A pulse motor 506 for adjusting head unit is provided on the supporting portion 505. A gear 503 is provided on a rotational shaft of the pulse motor 506. The gear 503 meshes with a gear 504.

The gear 504 is formed with a through-hole through which the shaft 91 extends, and the shaft 91 extends through the through-hole. When the pulse motor 506 is rotated, the shaft 91 is rotated via the gears 503 and 504. Incidentally, movement of the shaft 91 in a rotational direction is restricted by the gear 504 but movement thereof in the axial direction is not restricted.

Next, action of the automatic position adjustment of the head unit will be explained with reference to FIG. 15B and FIG. 15C.

First, at a power-on time of the apparatus, a pushing or pulling operation of the shaft 91 is performed by the pulse motor 500 and the engagement member 501 is detected by the origin sensor 508. The position of the shaft 91 is moved to the position (the starting point) shown in FIG. 10B. Incidentally, if the position of the shaft 91 at the power-on time of the apparatus is the position shown in FIG. 15B, it is unnecessary to perform the abovementioned operation.

Figure 16:
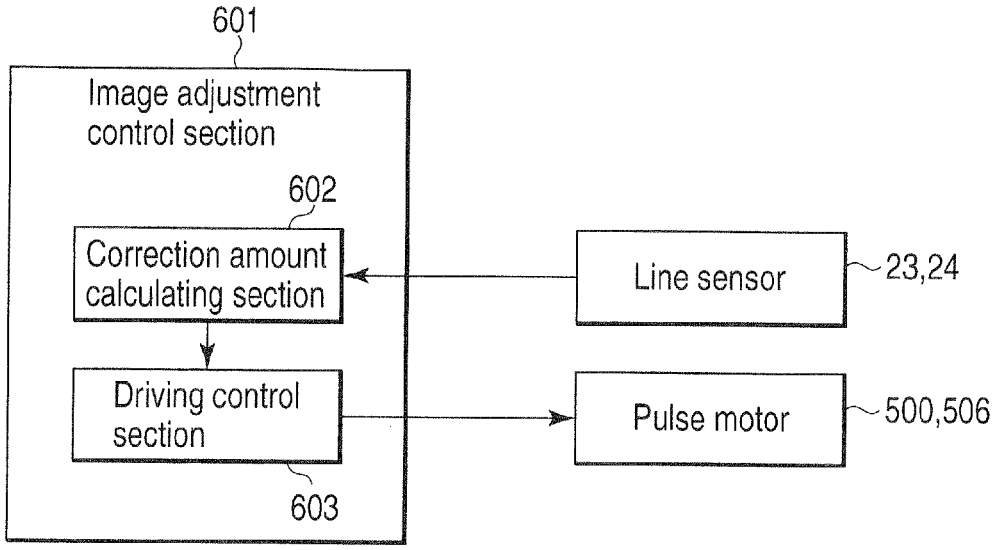
FIG. 16 is a diagram showing a configuration example of an image adjustment control section.

Next, an image printed on the recording medium 5 is imaged by the line sensors 23 and 24 provided on the image recording apparatus 1 shown in FIG. 1 according to an instruction from an image adjustment control section 601 shown in FIG. 16.

The image adjustment control section 601 comprises a correction amount calculating section 602 which calculates a correction amount based upon detection signals from the line sensors 23 and 24, and a drive control section 603 which controls drives of the pulse motors 500 and 506 according to an output from the correction amount calculating section 602.

That is, the correction amount calculating section 602 performs image processing of a position deviation of an ink droplet (dot deviation) on an image picked up and calculates the results of position adjustment amounts of the respective head units. The head unit(s) to be adjusted and an adjustment amount(s) thereof are notified to the drive control section 603 based upon the results of the position adjustment amounts calculated by the correction amount calculating section 602. For example, a case that angle adjustment of the head unit 200*b* is performed by Xm(rad) will be explained.

First, the correction amount calculating section 602 notifies the drive control section 603 so as to move the shaft 91 from the starting point shown in FIG. 15B by the amount corresponding to the distance L7. Incidentally, the pulse number corresponding to a distance from the starting point to a head unit to be adjusted is stored in the correction amount calculating section in advance. In other words, distances between the respective worm gears and the respective leaf springs are converted to pulse numbers to be stored based upon the starting position shown in FIG. 15B.

The drive control section 603 drives the pulse motor 500 based upon the pulse number notified from the correction amount calculating section 602. Thereby, the lead screw 502 is rotated and the shaft 91 is moved via the engagement member 501 by the distance L7 as shown in FIG. 16B to FIG. 16C. According to such an operation, the protruding portion of the leaf spring 404*a* is engaged with the groove of the worm gear 400*c*.

Second, the correction amount calculating section 602 notifies the drive control section 603 of the pulse number corresponding to Xm(rad). Incidentally, the pulse numbers corresponding to angles to be adjusted are stored in the correction amount control section 602 in advance.

The drive control section 603 drives the pulse motor 506 based upon the pulse number notified from the correction amount calculating section 602.

The driving force of the pulse motor 506 is transmitted from the worm gear 400*c* to the position adjusting member via the transmission mechanism so that angle adjustment of the head unit 200*b* is performed.

Third, after the angle adjustment of the head unit 200*b* is terminated, the position of the shaft 91 is returned back to the starting position shown in FIG. 16B.

Fourth, image recording is performed in order to confirm whether or not the angle adjustment of the head unit 200*b* has been achieved as expected. Line sensors 23 and 24 perform image processing of the position deviation of an ink droplet (a dot deviation), and the result of the position adjustment of the respective head unit is calculated. When the result falls within an allowable value range, the adjustment of the head unit is terminated. On the other hand, when the result is out of the allowable value range and the adjustment is insufficient, the position adjustment is performed from the abovementioned first step again.

With such a configuration, automatic position adjustment of the head unit becomes possible. Further, assembling steps or position adjustment of head units in a factory can be performed in a short time with a simple configuration.

Incidentally, in the abovementioned embodiments and modified examples thereof, the conveying mechanism of the drum type has been explained as an example, but the present invention is not limited to this type and a conveying mechanism performing conveyance utilizing a flat belt or a conveying mechanism performing conveyance utilizing a flat stage can be adopted.

It is unnecessary to permanently fix the shaft to the head holding member, and the shaft can be utilized as a jig for mounting to the head holding member only when position adjustment of the head unit is performed.

Figure 17:
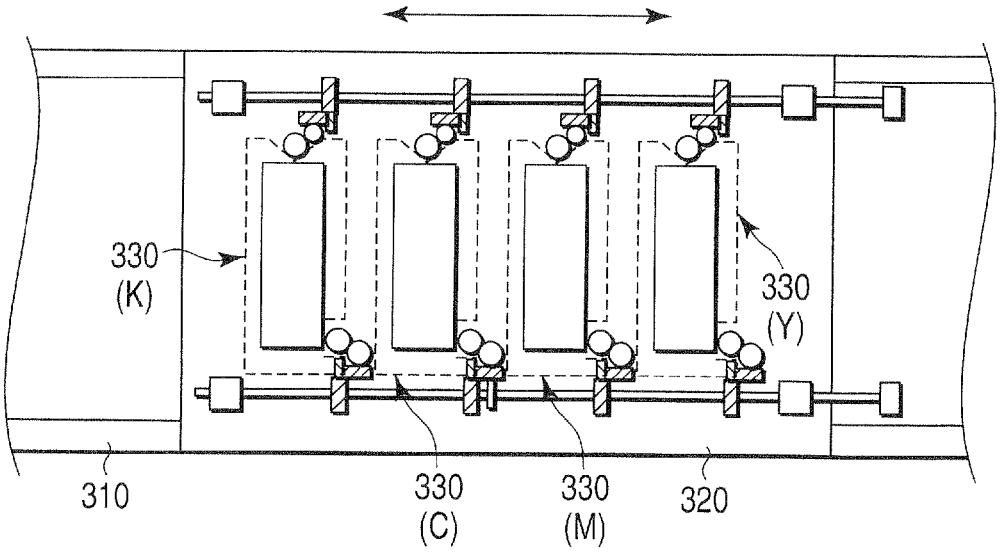
FIG. 17 is a diagram showing a configuration example when the present invention is applied to a serial type image recording apparatus.

Further, the image recording apparatus where a plurality of head units are arranged so as to be equal to or larger than the width of the recording medium has been explained, but the present invention can be applied to a serial type image recording apparatus, as shown FIG. 17.

An image recording apparatus shown in FIG. 17 comprises a carriage 320 provided with head units 330 (330(K) to 330(Y)) ejecting inks of, for example, black (K), cyan (C), magenta (M), and yellow (Y), and rails 310 which can move the carriage 320 in a direction of arrow in FIG. 17. By also applying the abovementioned position adjusting mechanism to the image recording apparatus where the carriage 320 is provided with a plurality of head units 330(*k*) to 330(Y) ejecting different colors, it is possible to adjust positions of all the head units individually.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording apparatus comprising:

a recording section having a head holding member holding a plurality of head units ejecting inks; and a position adjusting mechanism including position adjusting members, each being provided for each head unit, for adjusting a position of the head unit relative to the head holding member according to movement thereof, a driving mechanism for generating a force which moves the position adjusting member, and transmission mechanisms, each being provided for each position adjusting member, for transmitting the force generated by the driving mechanism to the position adjusting member, the driving mechanism selecting the transmission mechanism to be transmitted with the force from the plurality of transmission mechanisms to supply the force to only the selected transmission mechanism.

2. The image recording apparatus according to claim 1, wherein the driving mechanism includes at least a shaft and moves the shaft in an axial direction of the shaft to select a transmission mechanism to be transmitted with the force from the plurality of the transmission mechanisms and rotate the shaft, thereby generating the force.

3. The image recording apparatus according to claim 2, wherein the recording section includes a head unit line configured by arranging the plurality of head units in a direction perpendicular to a conveying direction of the recording medium, and the shaft is arranged so as to extend along the head unit line.

4. The image recording apparatus according to claim 3, further comprising positioning grooves formed on the shaft by the same number as the number of the transmission mechanisms, and a positioning detecting section including fitting members fitted in the positioning grooves, wherein when the shaft is moved in the axial direction, the transmission mechanism to be transmitted with the force is determined by selecting the positioning groove to be fitted with the fitting member.

5. The image recording apparatus according to claim 3, wherein at least one end of the shaft extends from the head holding member to the outside.

6. The image recording apparatus according to claim 2, wherein the recording section includes at least a first head unit line and a second head unit line configured by arranging the plurality of head units in a direction perpendicular to a conveying direction of the recording medium, and the shaft is arranged for each of the first head unit line and the second head unit line.

7. The image recording apparatus according to claim 2, wherein the recording section includes at least a first head unit line and a second head unit line configured by arranging the plurality of head units in a direction perpendicular to a conveying direction of the recording medium, and the shaft is arranged between the first head unit line and the second head unit line.

8. The image recording apparatus according to claim 2, further comprising positioning grooves formed on the shaft in the same number as the number of the transmission mechanisms, and a positioning detecting section including fitting members fitted in the positioning grooves, wherein when the shaft is moved in the axial direction, the transmission mechanism to be transmitted with the force is determined by selecting the positioning groove to be fitted with the fitting member.

9. The image recording apparatus according to claim 2, wherein at least one end of the shaft extends from the head holding member to the outside.

10. The image recording apparatus according to claim 2, wherein the driving mechanism further includes a gear, and the transmission mechanism to be transmitted with the force is selected by moving the shaft in the axial direction, and the force genera-ted by rotating the shaft is supplied to the selected transmission mechanism via the gear.

11. The image recording apparatus according to claim 10, wherein the recording section includes a head unit line configured by arranging the plurality of head units in a direction perpendicular to a conveying direction of the recording medium, and the shaft is arranged so as to extend along the head unit line.

12. The image recording apparatus according to claim 11, wherein the gear is fixed to the shaft, and the position of the gear is caused to coincide with the position of the transmission mechanism for transmitting the force by moving the shaft in the axial direction of the shaft and the gear rotates the shaft at the position of the gear.

13. The image recording apparatus according to claim 12, wherein the gear is provided for each transmission gear.

14. The image recording apparatus according to claim 12, further comprising positioning grooves formed on the shaft in the same number as the number of the transmission mechanisms, and a positioning detecting section including fitting members fitted in the positioning grooves, wherein when the shaft is moved in the axial direction, the transmission mechanism to be transmitted with the force is determined by selecting the positioning groove to be fitted with the fitting member.

15. The image recording apparatus according to claim 12, wherein at least one end of the shaft extends from the head holding member to the outside.

16. The image recording apparatus according to claim 11, wherein the shaft includes protruding portions, and the gears are disposed at positions corresponding to the transmission mechanisms and the respective gears are formed with holes which allow movement of the shaft and the protruding portions in the axial direction, where the positions of the protruding portions are caused to coincide with the positions of the gears arranged corresponding to the transmission mechanisms for transmitting the force by moving the shaft in the axial direction of the shaft, and the shaft and the gear is integrally rotated by the protruding portion according to rotating of the shaft at the position of the gear.

17. The image recording apparatus according to claim 1, wherein the position adjusting member includes a first position adjusting member which abuts on an end portion of the head unit to press the head unit, thereby moving the head unit in a widthwise direction of the recording medium, and a second position adjusting member which abuts on an end portion of the head unit to press the head unit, thereby moving the head unit in an oblique direction based upon the widthwise direction of the recording medium.

18. An image recording apparatus comprising:

a recording section including a head holding member having a plurality of head units ejecting ink arranged in a direction perpendicular to a conveying direction of a recording medium; and a position adjusting mechanism including position adjusting members, each being provided for each head unit, for adjusting a position of the head unit relative to the head holding member according to movement thereof, a driving mechanism for generating a force which moves the position adjusting member, and transmission mechanisms, each being provided for each position adjusting member, for transmitting the force generated by the driving mechanism to the position adjusting member, the driving mechanism selecting the transmission mechanism to be transmitted with the force from the plurality of transmission mechanisms according to movement in the direction perpendicular to the conveying direction of the recording medium, thereby supplying the force to only the selected transmission mechanism.

19. The image recording apparatus according to claim 18, wherein the driving mechanism includes a shaft extending in a direction perpendicular to the conveying direction of the recording medium and gears, and the driving mechanism selecting the transmission mechanism to be transmitted with the force from the plurality of transmission mechanisms by moving the shaft in the axial direction of the shaft, the force is generated by rotating the shaft, and the generated force is supplied to the selected transmission mechanism via the gear.

20. An image recording apparatus comprising:

a recording section including a head holding member having a plurality of head units ejecting ink arranged in a direction perpendicular to a conveying direction of a recording medium;

a position adjusting mechanism including position adjusting members, each being provided for each head unit, for adjusting a position of the head unit relative to the head holding member according to movement thereof, a driving mechanism for generating a force which moves the position adjusting member, and transmission mechanisms, each being provided for each position adjusting member, for transmitting the force generated by the driving mechanism to the position adjusting member;

an imaging section which images an image recorded on the recording medium by the recording section; and a control section calculating adjusting amounts of the head units from the image imaged by the imaging section to control the position adjusting mechanism based upon the calculated adjusting amounts, wherein the driving mechanism selects the transmission mechanism to be transmitted with the force from the plurality of transmission mechanisms according to movement in the direction perpendicular to the conveying direction of the recording medium based upon the adjusting amounts calculated by the control section, thereby supplying the force to only the selected transmission mechanism.

* * * * *